US007448431B2

(12) United States Patent
Miki et al.

(10) Patent No.: US 7,448,431 B2
(45) Date of Patent: Nov. 11, 2008

(54) METHOD OF CONTINUOUS STEEL CASTING

(75) Inventors: Yuji Miki, Tokyo (JP); Shuji Takeuchi, deceased, late of Tokyo (JP); by Yuko Takeuchi, legal representative, Chiba (JP); Akira Yamauchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 16 days.

(21) Appl. No.: 10/552,414

(22) PCT Filed: Jan. 29, 2004

(86) PCT No.: PCT/JP2004/000864

§ 371 (c)(1),
(2), (4) Date: Jul. 13, 2006

(87) PCT Pub. No.: WO2004/091829

PCT Pub. Date: Oct. 28, 2004

(65) Prior Publication Data

US 2007/0272388 A1 Nov. 29, 2007

(30) Foreign Application Priority Data

Apr. 11, 2003 (JP) ..... 2003-108344
Apr. 22, 2003 (JP) ..... 2003-117340

(51) Int. Cl.
*B22D 11/115* (2006.01)
*B22D 27/04* (2006.01)

(52) U.S. Cl. ..... 164/468; 164/504

(58) Field of Classification Search ..... 164/466, 164/468, 502, 504
See application file for complete search history.

(56) References Cited

U.S. PATENT DOCUMENTS 6,117,389 A * 9/2000 Nabeshima et al. ..... 420/83
6,712,124 B1 3/2004 Yamane et al.

FOREIGN PATENT DOCUMENTS

| | | | |
|---|---|---|---|
| EP | 0 972 591 | A1 | 1/2000 |
| JP | 57-039065 | A | 3/1982 |
| JP | 61-140355 | A | 6/1986 |
| JP | 61-193755 | A | 8/1986 |
| JP | 63-119959 | A | 5/1988 |
| JP | 02-284750 | A | 11/1990 |
| JP | 03-258442 | A | 11/1991 |
| JP | 05-154623 | A | 6/1993 |
| JP | 06-190520 | A | 7/1994 |

(Continued)

OTHER PUBLICATIONS

"Zairyou-to-purosesu" 1990, vol. 3, p. 256 entitled Electrodynamic Control of Molten Steel Flow in Mold for High Speed Slab Casting.

(Continued)

*Primary Examiner*—Kuang Lin
(74) *Attorney, Agent, or Firm*—Frishauf, Holtz, Goodman & Chick, P.C.

(57) ABSTRACT

At least three electromagnets are disposed along the longitudinal direction of a mold. While the electromagnets generate a vibrating magnetic field, peak positions of the vibrating magnetic field is shifted in the longitudinal direction of the mold.

26 Claims, 18 Drawing Sheets

FOREIGN PATENT DOCUMENTS

| | | | |
|---|---|---|---|
| JP | 06-226409 | A | 8/1994 |
| JP | 08-019840 | A | 1/1996 |
| JP | 08-019841 | A | 1/1996 |
| JP | 09-262650 | A | 10/1997 |
| JP | 09-262651 | A | 10/1997 |
| JP | 10-305353 | A | 11/1998 |
| JP | 2856960 | B2 | 11/1998 |
| JP | 11-100611 | A | 4/1999 |
| JP | 2917223 | B2 | 4/1999 |
| JP | 3067916 | B2 | 5/2000 |
| JP | 2000-271710 | A | 10/2000 |
| JP | 2000-326054 | A | 11/2000 |
| JP | 2002-28763 | A | 1/2002 |
| JP | 2003-103348 | * | 4/2003 |
| JP | 2003-103348 | A | 4/2003 |
| JP | 2003-103349 | * | 4/2003 |
| JP | 2003-103349 | A | 4/2003 |
| JP | 2004-58092 | * | 2/2004 |
| WO | WO 95/26243 | A1 | 10/1995 |

OTHER PUBLICATIONS

"Tetsu-to-Hagane" 1980, 68, p. 197.

Notification Concerning Transmittal of the International Preliminary Report on Patentability, Chapter I of the Patent Cooperation Treaty for PCT/JP2004/000864, 5 sheets.

* cited by examiner

| | | | | | | | | | | | | |
|---|---|---|---|---|---|---|---|---|---|---|---|---|
| $T_1$ | 0 | 90 | 180 | 270 | 0 | 90 | 180 | 270 | 0 | 90 | 180 | 270 |
| $T_2$ | 90 | 180 | 270 | 0 | 90 | 180 | 270 | 0 | 90 | 180 | 270 | 0 |
| $T_3$ | 180 | 270 | 0 | 90 | 180 | 270 | 0 | 90 | 180 | 270 | 0 | 90 |
| $T_4$ | 270 | 0 | 90 | 180 | 270 | 0 | 90 | 180 | 270 | 0 | 90 | 180 |

| | | | | | | | | | | | | |
|---|---|---|---|---|---|---|---|---|---|---|---|---|
| $T_1$ | 0 | 90 | 180 | 90 | 0 | 90 | 180 | 90 | 0 | 90 | 180 | 90 |

| | | | | | | | | | | | | |
|---|---|---|---|---|---|---|---|---|---|---|---|---|
| $T_1$ | 60 | 180 | 120 | 60 | 180 | 120 | 60 | 180 | 120 | 60 | 180 | 120 |

METHOD OF CONTINUOUS STEEL CASTING

This application is a U.S. National Phase Application under 35 USC 371 of International Application PCT/JP2004/000864 filed Jan.29, 2004.

1. Technical Field

The present invention relates to continuous steel casting methods, and particularly to a continuous steel casting method in which the flow of a molten steel in a continuous casting mold (hereinafter referred to as mold) is improved without blowing an inert gas from a nozzle for feeding the molten steel into the mold, by applying a magnetic field.

2. Background Art

Improvement in quality of steel products, mainly automotive steel sheets, has recently been strictly desired, and the need for high-quality clean slabs intensifies accordingly. For producing such a high-quality slab, Japanese Unexamined Patent Application Publication No. 11-100611 has disclosed a continuous steel casting without gas blowing. This technique prevents clogging of an immersion nozzle for feeding a molten steel into a mold by reducing the melting points of inclusions in the molten steel, thereby eliminating the necessity of blowing an inert gas, such as argon (Ar), through the nozzle.

Such continuous casting without inert gas blowing prevents entrapment of air bubbles at the surface of the cast slab, and consequently provides improved surface properties in comparison with casting with gas blowing. However, if molten steel temperature drops in the mold, mold flux is locally solidified and entrained into the molten steel to result in internal defects disadvantageously. Additionally, further improvement of the surface properties is desired.

Some defects in slabs are caused by inclusions or air bubbles, or segregation in molten steel. These deeply associated with the molten steel flow in the mold. Accordingly, many studies and inventions have been made about the molten steel flow. Among these are approaches of controlling the molten steel flow in the mold by a magnetic field.

For example, (A) a direct-current magnetic field is superimposed on a traveling magnetic field. Japanese Unexamined Patent Application Publication No. 10-305353 has disclosed a method for controlling the molten steel flow in a mold by applying a magnetic field to opposing upper and lower magnetic poles disposed at the back surfaces of the wide faces of the mold, separated by the wide faces. In the method, (a) a direct-current static magnetic field and an alternating traveling magnetic field superimposed on each other are applied to the lower magnetic pole; or (b) a direct-current static magnetic field and an alternating traveling magnetic field superimposed on each other are applied to the upper magnetic pole and a direct-current static magnetic field is applied to the lower magnetic pole.

Japanese Patent No. 3067916 has disclosed an apparatus for controlling the molten steel flow in a mold by passing an appropriate linear drive alternating current and braking direct current through a plurality of electrical coils.

Japanese Unexamined Patent Application Publication No. 5-154623 has disclosed method for controlling the molten steel flow in a mold by superimposing a direct-current static magnetic field and alternating traveling magnetic fields whose phases are 120° shifted from each other.

Japanese Unexamined Patent Application Publication No. 6-190520 has disclosed a steel casting method in which while a magnet disposed above the spout of an immersion nozzle applies a static magnetic field and a high-frequency magnetic field which are superimposed on each other over the entire area in a width direction, a magnet disposed under the spout applies a static magnetic field.

(B) There are techniques in which an upper direct-current magnetic field is combined with a lower traveling magnetic field. For example, Japanese Unexamined Patent Application Publication No. 61-193755 has disclosed an electromagnetic agitation method in which while a static magnetic field is applied to a region surrounding the discharge flow of a molten steel from an immersion nozzle to reduce the flow rate, an electromagnetic agitator disposed downstream from the static magnetic field agitates the flow in the horizontal direction.

(C) There are techniques in which an upper traveling magnetic field is combined with a lower direct-current magnetic field. For example, Japanese Unexamined Patent Application Publication No. 6-226409 has disclosed a casting method in which while a traveling magnetic field is applied with a magnet whose pole core center is located between the bath level and the spout (downward at an angle of 50° or more) of an immersion nozzle, a static magnetic field is applied with a magnet whose pole core center is located below the immersion nozzle.

Japanese Unexamined Patent Application Publication No. 9-262651 has disclosed a casting method in which a magnet capable of applying a traveling magnetic field and a static magnetic field applies either the static magnetic field or the traveling magnetic field according to the type of steel and the casting speed. The magnet is disposed below the lower end of an immersion nozzle, and an electromagnetic agitator magnet is disposed above the lower end of the immersion nozzle.

Japanese Unexamined Patent Application Publication No. 2000-271710 has disclosed a method for casting steel while Ar gas is blown into an immersion nozzle. In the method, a static magnetic field having a magnetic flux density of 0.1 T or more is applied to the molten steel flow immediately after being discharged from the immersion nozzle, and an electromagnetic agitator above the static magnetic field continuously agitates the flow or periodically changes the agitation direction.

Japanese Unexamined Patent Application Publication No. 61-140355 has disclosed a mold and an upper structure of the mold. The mold has static magnetic fields at its wide faces for controlling the molten steel current fed into the mold, and traveling magnetic field generators are disposed above the mold so as to allow the upper surface of the molten steel to flow from the center of its horizontal section toward the narrow faces.

Japanese Unexamined Patent Application Publication No. 63-119959 has disclosed a technique for controlling the discharge flow from an immersion nozzle by an electromagnetic agitator disposed above the mold for allowing the molten steel to flow horizontally and an electromagnetic brake disposed below the mold for reducing the rate of the flow from the immersion nozzle.

Japanese Patent No. 2856960 has disclosed a technique for controlling the molten steel flow in a mold, using a static magnetic field at the bath level in the mold, a traveling magnetic field around the spout of a straight nozzle as a continuous casting nozzle, and a static magnetic field below the spout.

(D) There are techniques in which a direct-current magnetic field is singly applied. For example, Japanese Unexamined Patent Application Publication No. 3-258442 has disclosed an electromagnetic brake including electromagnets applying static magnetic fields, opposing the wide faces of a mold and having substantially the same length as that of the wide faces.

Japanese Unexamined Patent Application Publication No. 8-19841 has disclosed a method for controlling the molten steel flow in a mold by applying a direct-current magnetic field or a low-frequency alternating magnetic field from a magnetic pole disposed below the spout of an immersion nozzle at the center of the width of the mold. The magnetic pole is bent or inclined upward from the center of the width of the mold or a predetermined position between the narrow faces of the mold toward the vicinities of the mold edge.

PCT Patent Publication WO95/26243 has disclosed a technique for controlling the surface velocity of the discharge flow from an immersion nozzle to 0.20 to 0.40 m/s by applying a direct-current magnetic field having substantially uniform flux density distribution, over the entire width of a mold in the thickness direction of the mold.

Japanese Unexamined Patent Application Publication No. 2-284750 has disclosed a technique for uniformizing the discharge flow (flow from the nozzle spouts) of a molten steel by applying to an upper portion and a lower portion of an immersion nozzle a static magnetic field uniform in the thickness direction of a mold over the entire width of the cast slab to give an effective braking force to the flow.

(E) There are techniques in which a direct-current magnetic field or a traveling magnetic field is applied. For example, Japanese Unexamined Patent Application Publication No. 9-262650 has disclosed a casting method in which the molten steel flow is controlled by passing a direct current through a plurality of coils disposed below the spout of an immersion nozzle to apply a static magnetic field, or by passing an alternating current through the coils to apply a traveling magnetic field.

Also, a technique is disclosed in "Zairyou-to-purosesu" 1990, Vol. 3, p. 256 which stabilizes the discharge flow of a molten steel from an immersion nozzle (so-called EMLS) or accelerates it (so-called EMLA) by applying an alternating traveling magnetic field to the discharge flow.

(F) Also, there are techniques in which a traveling magnetic field is singly applied. For example, Japanese Unexamined Patent Application Publication No. 8-19840 has disclosed a technique in which a static alternating magnetic field having a frequency of 1 to 15 Hz is applied when the molten steel flow in a mold is controlled by electromagnetic induction.

"Tetsu-to-Hagane" 1980, 66, p. 197 has disclosed a technique (so-called M-EMS) in which a continuous slab casting apparatus produces a rotating flow of a molten steel in the horizontal direction along the walls of a mold by electromagnetic agitation.

Unfortunately, these techniques (A) to (F) often cause mold powder to be trapped, or cannot prevent entrapment of inclusions at solidification interfaces, and consequently the surface quality of the resulting cast slab cannot be improved sufficiently. In view of such circumstances, approaches have been studied which apply a magnetic field whose Lorentz force direction is periodically reversed (hereinafter referred to as vibrating magnetic field).

For example, (G) a vibrating magnetic field is simply applied. Japanese Patent No. 2917223 has disclosed a method in which columnar dendrite structure at the front surface of the solidified steel is fractured to float in the molten steel by applying a low-frequency alternating static magnetic field not shifting with time so as to excite a low-frequency electromagnetic vibration immediately before solidification, and thereby finer solidification structure and less central segregation are achieved. However, the method is less effective at reducing defects at the surface of the cast slab.

DISCLOSURE OF INVENTION

Effective control of the molten steel flow in a mold has been increasingly desired, according to the increase of recent demands for improved surface quality of cast slabs and cost reduction, and for further improvement of surface and internal quality of the cast slabs.

The present invention is intended to overcome the above-described disadvantages in the known art, and the object of the invention is to provide a continuous steel casting method without blowing an inert gas from an immersion nozzle, and which increases the internal quality of cast slabs by preventing entrainment of mold flux, and simultaneously increases the surface quality of the cast slabs by preventing entrapment of inclusions and air bubbles into a solidifying nucleus.

In order to accomplish the object, the present invention regulates the flow rate distribution of the unsolidified molten steel in a mold. Specifically, while the molten steel flow rate is reduced around the center of the thickness of a cast slab (in the width direction of the mold) to prevent the entrainment of mold flux, the flow rate is increased in the vicinities of solidification interfaces close to the walls of the mold to give a cleaning effect to inclusions and air bubbles, and thus to prevent the entrapment of inclusions and air bubbles into a solidification nucleus.

In the method of the present invention, for casting without blowing an inert gas from an immersion nozzle for feeding molten steel to a mold, the temperature of the molten steel in the mold is uniformized by electromagnetic agitation. For this purpose, the molten flow rate distribution in the widthwise direction of the mold (or the thickness direction of the cast slab) is regulated. More specifically, defects at the surface of the cast slab is reduced by allowing the molten steel to locally flow at the solidification interfaces close to the walls of the mold to prevent the entrapment of inclusions and air bubbles and by reducing the molten steel flow rate around the center of the thickness of the cast slab to prevent the entrainment of mold flux into the molten steel.

In order to achieve this idea, it has been necessary to devise a method for applying an alternating magnetic field. The inventors have conducted model experiments and calculating simulations, and come to the following conclusion.

The Lorentz force induced by a magnetic field in the thickness direction of the cast slab, as disclosed in Japanese Unexamined Patent Application Publication No. 6-190520, is concentrated on the solidification interfaces or the surfaces of the molten steel by the skin effect of an alternating current. However, the use of the skin effect is not sufficient to concentrate the Lorentz force efficiently on only the solidification interfaces. In order to concentrate the Lorentz force on the solidification interfaces, it is necessary to control the distribution of magnetic force lines.

For this purpose, it is effective to dispose electromagnets along the width of the cast slab (longitudinal direction of the mold) so that the phases of their magnetic fields are alternately reversed. If a magnetic field is vibrated in the thickness direction of the cast slab, the electromagnetic force cannot be concentrated on the walls of the mold, that is, the solidification interfaces. It is therefore necessary to vibrate the magnetic field in the width direction of the cast slab. In this instance, the phases of the current applied to the electromagnets must be substantially reversed alternately. Accordingly, at least 130° out-of-phase currents must be alternately applied.

FIG. 1 shows the structure of coils through which an alternating current is passed (hereinafter referred to as the AC coil). Sinking comb-shaped iron cores 22 each have at least three magnetic poles arranged in the width direction of the cast slab. The coils are wound around the magnetic poles, and the current phases of any two adjacent coils are substantially reversed to vibrate the magnetic field in the width direction. In FIG. 1, reference numeral 10 designates the mold; 12, an immersion nozzle; 14, a molten steel (hatched areas represents a low flow rate region). An excessively low frequency of the alternating current does not excite flows sufficiently; an excessively high frequency does not allow the molten steel to follow the electromagnetic field. Accordingly, the frequency of the alternating current is set in the range of 1 to 8 Hz.

The use of such electromagnets can induce flows in directions separating the molten steel from the front surfaces of the solidified steel, and allow the rate of the excited molten steel flow to be low. Accordingly, a cleaning effect is produced at the solidification interfaces without fracturing dendrite. Molten steel flows induced by the vibrating magnetic field of the present invention are schematically illustrated in FIG. 2 (front view), FIG. 3 (horizontal sectional view taken along line III-III in FIG. 2), and FIG. 4 (vertical sectional view taken along line IV-IV in FIG. 2). The molten steel flows shown in the figures are calculated by electromagnetic field analysis and fluid analysis of a case where the number of the magnetic poles 28 is four. In FIG. 2, line III-III passes through the centers of the magnetic poles 28. Arrow a designates the casting direction; arrow b, the longitudinal direction of the mold. Arrows c designates local flows of a molten steel 14. Arrow d in FIG. 3 designates the widthwise direction of the mold.

In the present invention, the direction of a flow occurring according to a Lorentz force F, which is expressed by the following expression, is constant, but its flow rate V is changed in a cycle of half the frequency of the applied voltage I, as shown in FIG. 5:

$$F \propto J \times B \tag{1}$$

Where J represents an induced current; B, a magnetic field.

A reversed winding direction of an AC coil makes the phase of the corresponding magnetic field reversed even if current phases are the same.

In the above-cited Japanese patent No. 2917223, in order to get finer solidification structure and less central segregation, columnar dendrite structure at the front surfaces of the solidified steel is fractured to float in the molten metal by applying a low-frequency alternating static magnetic field not shifting with time so as to excite low-frequency electromagnetic vibration. However, if such a large electromagnetic force as to fracture the columnar dendrite is applied, the mold flux at the upper surface of the molten bath is entrained into the molten steel to degrade the surface quality. Accordingly, a preferred magnetic flux density of the alternating vibrating magnetic field is less than 1,000 G. In some cases, the dendrite may not be fractured even at 1,000 G or more, depending on the arrangement of the coils.

Furthermore, in the method disclosed in Japanese Patent No. 2917223, the fracture of dendrite causes the columnar grains of the dendrite to turn into equiaxed grains. In ultra low carbon steel or the like, a structure composed of columnar grains is easy to control as a texture. The change of the columnar grains into equiaxed grains makes it difficult to align the crystal orientation disadvantageously. It is therefore important that an electromagnetic force does not fracture the dendrite at the front surfaces of the solidified steel.

Thus, the inventors has come to the conclusion that, for the prevention of entrapment of air bubbles and inclusions, it is effective to create molten steel flows which separate air bubbles and inclusions from the solidification interfaces (interfaces between liquidus and solidus) by vibrating magnetic fields in the longitudinal direction (direction along the wide face) of the mold so as to induce flows in the thickness direction of the cast slab and the casting direction.

The present invention can efficiently vibrate only the solidification interfaces to prevent the entrapment of air bubbles and inclusions. Thus, the surface quality of the resulting cast slab can be significantly improved.

In addition, model experiments and calculating simulations for improving the quality of cast slabs have led to findings that it is effective to superimpose a static magnetic field in the widthwise direction of the mold (thickness direction of the cast slab) together with the application of the vibrating magnetic field to the molten steel in the mold.

Accordingly, the coils shown in FIG. 1 may be provided with additional coils 34 (hereinafter referred to as the DC coils) through which a direct current passes, as shown in FIG. 6.

By superimposing a static magnetic field with the DC coil 34, the magnetic field B in the expression F=J×B (F: Lorentz force, J: induced current, B: magnetic field) is increased, and the Lorentz force is increased, accordingly. Also, the direction of the Lorentz force differs largely from that in the case where the static magnetic field is not superimposed. Consequently, the directions of the molten steel flows are changed such that the flows become large in the width direction of the cast slab and the casting direction. Thus, the effect of cleaning air bubbles and inclusions trapped at the solidification interfaces is expected.

Also, the superimposition allows the molten steel flow rate being reduced at the center of the thickness of the cast slab, thus further efficiently preventing the entrainment of mold flux.

Molten steel flows induced at a certain time by the vibrating magnetic field of the present invention are schematically illustrated in FIG. 7 (front view), FIG. 8 (horizontal sectional view taken along line III-III in FIG. 7), and FIG. 9 (vertical sectional view taken along line IV-IV in FIG. 7). The molten steel flows in the figures are calculated by electromagnetic field analysis and fluid analysis of a case where the number of the poles 28 is four. In FIG. 7, arrow a designates the casting direction; arrow b, the longitudinal direction of the mold. Arrows c designates local flows of a molten steel 14. Arrow d in FIG. 8 designates the widthwise direction of the mold. Molten steel flows at the next point of time are schematically illustrated in FIG. 10 (front view), FIG. 11 (horizontal sectional view taken along line VI-VI in FIG. 10), and FIG. 12 (vertical sectional view taken long line VII-VII in FIG. 10).

In the present invention, the direction of a flow occurring according to a Lorentz force F, which is expressed by the following expressions, is reversed in the same cycle as the frequency of the applied current I, as shown in FIG. 13:

$$F \propto J \times Bt \tag{2}$$

$$Bt = Bdc + Bac > 0 \tag{3}$$

Where J represents an induced current; Bt, a total magnetic field; Bdc, a direct-current magnetic field; Bac, an alternating magnetic field.

In this instance, also, the frequency of the alternating current for vibrating the magnetic fields preferably ranges from 1 to 8 Hz.

According to the above-described findings, the entrapment of air bubbles and inclusions is prevented to significantly improve the surface quality of cast slabs by applying a direct-current magnetic field in the thickness direction of the cast slab while magnetic fields are vibrated in the longitudinal direction of the mold so that molten steel flows largely different from the flows created by known techniques are induced to vibrate only the solidification interfaces in the longitudinal direction of the mold and the casting direction.

Furthermore, in order to devise a mode for applying an alternating magnetic field, the inventors have conducted model experiments and calculating simulations, and come to the following conclusion.

A macroscopic flow created by a traveling magnetic field prevents the entrapment of air bubbles and inclusions at the solidification interfaces, but it, on the contrary, increases the entrainment of mold flux in the molten steel to degrade the quality in some cases.

If positions to receive strongly the applied vibrating magnetic field are fixed, the entrapment of inclusions may not be sufficiently prevented in some positions with weak electromagnetic forces. It is therefore effective to shift peak positions of the Lorentz force of the vibrating magnetic field.

In order to shift the peak positions of the Lorentz force, three adjacent AC coils provided to the electromagnets or a group of AC coils can be arranged so that the phase of the middle coil appears last. The vibrating magnetic field herein refers to a magnetic field in which the direction of the Lorentz force is reversed with time.

The shift of the peak positions of Lorentz forces will now be described. A vibrating magnetic field is applied to each of sinking comb-shaped coils 24 shown in FIG. 14 (detailed below with reference to FIG. 20), having substantially the same structure as shown in FIG. 6 to vary the phases of the coils. FIGS. 15 to 18 illustrate the phases applied to the coils. The numerals beside the AC coils 24*a* and 24*b* represent current phase angles (degree) at the respective AC coils at a certain time. A two-phase alternating magnetic field is applied in the cases shown in FIGS. 15 to 17; a three-phase alternating magnetic field, in the case shown in FIG. 18. FIG. 15 shows the case where a traveling magnetic field is applied; FIG. 16 shows the case where a vibrating magnetic field is applied; FIGS. 17 and 18 each show the case where the peak positions of the vibrating magnetic field are locally shifted.

As shown in FIGS. 17 and 18, current is applied to at least three electromagnets disposed along the longitudinal direction of the mold (width direction of the cast slab) so that the phase at the middle of a group of three adjacent electromagnets lags the other two phases without increasing or reducing the phase angles in one direction. Thus, the magnetic field can be locally shifted with vibration, but not shifted simply in one direction.

As described above, by providing with the arrangement of at least three electromagnets a part where the current phases at three adjacent AC coils are in the order of n, 2n, and n or n, 3n, and 2n (n represents 90° for two-phase alternating current; 60° C. or 120° for three-phase alternating current), the peak positions of the vibrating magnetic field can be locally shifted.

If a vibrating magnetic field is simply induced, the vibrating magnetic field has a large amplitude region and a small amplitude region. By locally shifting the peak positions, the solidification interfaces can be cleaned at any region.

While the cores in the figures have 12 sinking comb-shaped AC coils each, the number of the sinking comb-shaped coils is selected from among 4, 6, 8, 10, 12, 16, and so on and the alternating current may be two-phase or three-phase.

Accordingly, the present invention overcomes the above-described disadvantages by a method in which peak positions of a vibrating magnetic field are shifted along the longitudinal direction of the mold while the vibrating magnetic field is generated with an arrangement of at least three electromagnets disposed along the longitudinal direction of the mold.

Preferably, the arrangement of at least three electromagnets has a part where coil phases of three adjacent electromagnets are in the order of n, 2n, and n or n, 3n, and 2n, wherein n=60° or 120° for three-phase alternating current; n=90° for two-phase alternating current. Preferably, a direct-current magnetic field is superimposed on the vibrating magnetic field in the thickness direction of the cast slab.

Additionally, the melting points of inclusions in the molten steel are reduced so that a nozzle from which the molten steel is fed is prevented from being clogged, and thereby continuous casting is performed without blowing an inert gas from the nozzle. In this instance, preferably, the molten steel is an ultra low carbon steel deoxidized by Ti having a composition containing: C≦0.020% by mass, Si≦0.2% by mass, Mn≦1.0% by mass, S≦0.050% by mass, and Ti≧0.010% by mass, and satisfying the relationship Al≦Ti/5 on a content basis of percent by mass.

Preferably, the molten steel is decarburized with a vacuum degassing apparatus, subsequently deoxidized with a Ti-containing alloy, and then an alloy for controlling the composition of inclusions is added to the molten steel. The alloy contains at least one metal selected from among 10% by mass or more of Ca and 5% by mass or more of REMs and at least one element selected from the group consisting of Fe, Al, Si, and Ti. Thus, the resulting oxide in molten steel is allowed to contain 10% to 50% by mass of at least one selected from the groups consisting of CaO and REM oxides, 90% by mass or less of Ti oxide, and 70% by mass or less of $Al_2O_3$.

Preferably, the molten steel after the decarburization is pre-deoxidized with Al, Si, or Mn so that the concentration of dissolved oxide in the molten steel is adjusted to 200 ppm or less before the deoxidization with the Ti-containing alloy.

Preferably, the maximum value of Lorentz forces induced by the vibrating magnetic field is in the range of 5,000 $N/m^3$ or more and 13,000 $N/m^3$ or less. Preferably, the flow rate V (m/s) of the unsolidified molten steel in the mold for continuous casting and the maximum Lorentz force $F_{max}$ ($N/m^3$) induced by the vibrating magnetic field are adjusted so that $V \times F_{max}$ is 3,000 $N/(s \cdot m^2)$ or more.

REFERENCE NUMERALS

Figure 1:
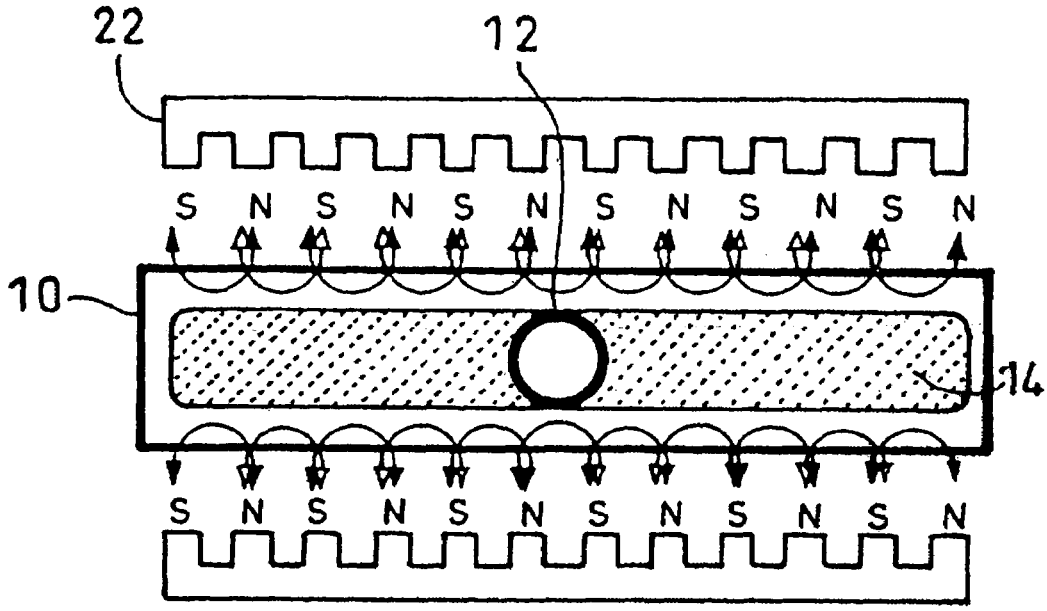
FIG. 1 is a schematic horizontal sectional view of a combination of electromagnets and a mold used in the present invention.
Figure 2:
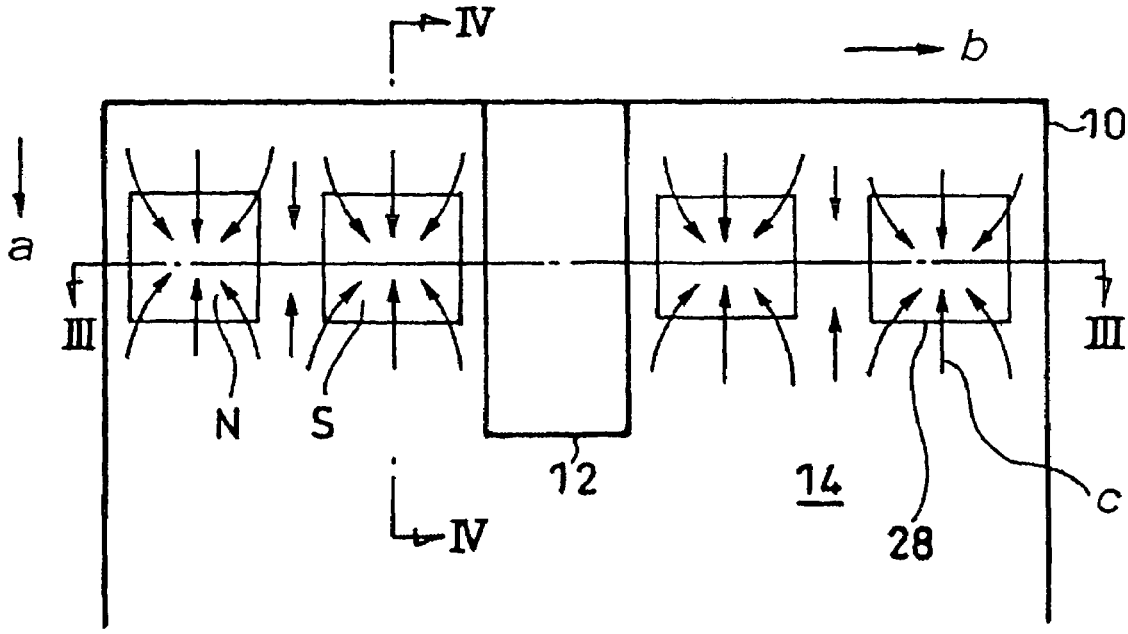
FIG. 2 is a schematic front view for explaining the principle of the present invention, showing velocity vectors of molten steel flows induced by magnetic fields, the velocity vectors according to calculating analyses of the magnetic fields and the flows.
Figure 3:
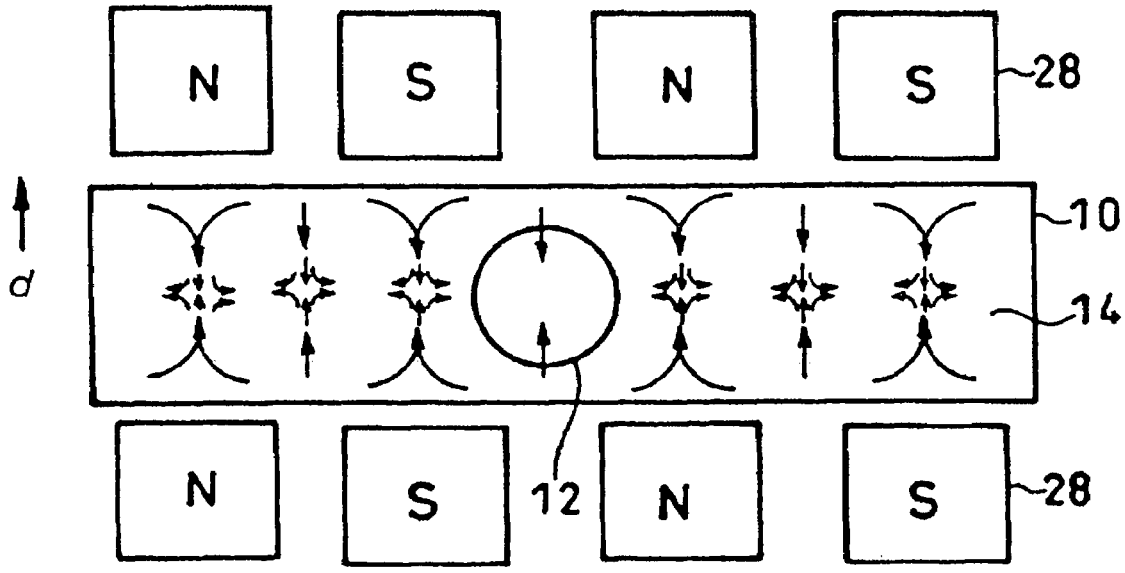
FIG. 3 is a horizontal sectional view taken along line III-III in FIG. 2.
Figure 4:
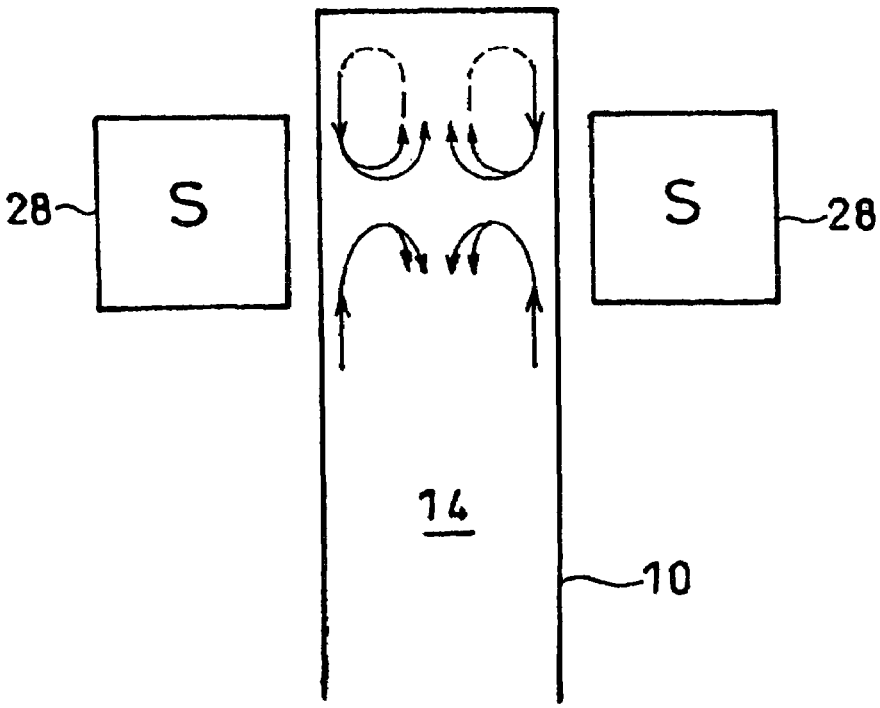
FIG. 4 is a vertical sectional view taken along line IV-IV in FIG. 2.
Figure 5:
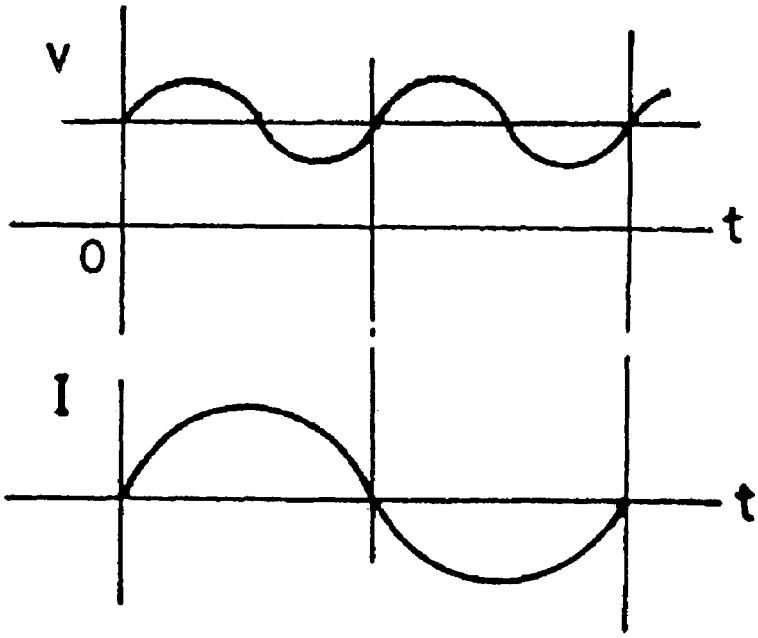
FIG. 5 is a diagram showing the changes in applied current and molten steel flow rate with time according to the present invention.

10 mold
12 immersion nozzle
14 molten steel
20 vibrating magnetic field generator
22 sinking comb-shaped iron core
24 AC coils
26*a*, 26*b* AC power source
28 magnetic pole
30 static magnetic field generator
32 DC power source
34 DC coil

BEST MODE FOR CARRYING OUT THE INVENTION

The present invention will now be described with reference to the drawings. In the present invention, an immersion nozzle 12 hung from the bottom of a tundish (not shown in the figure) disposed above the nozzle 12 is immersed in unsolidified molten steel 14 in a mold 10, and the molten steel 14 is fed from the immersion nozzle 12, as shown in FIG. 1. At least three electromagnets (AC coils) are arranged outside each wide face of the mold 10 and constitute a vibrating magnetic field generator. A vibrating current for generating a vibrating magnetic field is applied to each of the electromagnets (AC coils) so that the peak value of the vibrating current shifts along the longitudinal direction of the mold 10. For the shift, the current is applied so that the arrangement of coil phases has a part where phases of three adjacent AC coils are in the order of n, 2n, and n or n, 3n, and 2n.

A first embodiment of the present invention will be described in detail, in which a vibrating magnetic field is singly applied with such an apparatus.

In the first embodiment, a vibrating magnetic field is applied to an unsolidified molten steel in the mold while continuous casting is performed in which the melting points of inclusions in the molten steel are reduced so that a nozzle for feeding the molten steel into the mold is prevented from being clogged to eliminate the necessity of blowing an inert gas from the nozzle.

The above-cited Japanese Unexamined Patent Application Publication No. 11-100611 has disclosed a molten steel for continuous steel casting without gas blowing whose inclusions have low melting points. This molten steel is, for example, an ultra low carbon steel deoxidized by Ti having a composition containing: $C \leqq 0.020\%$ by mass, $Si \leqq 0.2\%$ by mass, $Mn \leqq 1.0\%$ by mass, $S \leqq 0.050\%$ by mass, and $Ti \geqq 0.010\%$ by mass, and satisfying the relationship $Al \leqq Ti/5$ on a content basis of percent by mass. The molten steel is decarburized with a vacuum degassing apparatus and subsequently deoxidized with a Ti-containing alloy. Then, an alloy for controlling the composition of inclusions is added to the molten steel. This alloy contains: at least one metal selected from among 10% by mass or more of Ca and 5% by mass or more of REMs (rare earth metals); and at least one element selected from the group consisting of Fe, Al, Si, and Ti. Thus, the resulting oxide in molten steel is allowed to contain: 10% to 50% by mass of at least one oxide selected from the group consisting of CaO and REM oxides; 90% by mass or less of Ti oxide; and 70% by mass or less of $Al_2O_3$. Preferably, the decarburized molten steel is pre-deoxidized with Al, Si, or Mn before the deoxidization with the Ti-containing alloy so that the concentration of dissolved oxide in the molten steel is adjusted to 200 ppm or less in advance.

In order to reduce defects at the surface of cast slabs, the molten steel prepared above is electromagnetically agitated in a mold as follows during continuous casting without gas blowing.

Figure 19:
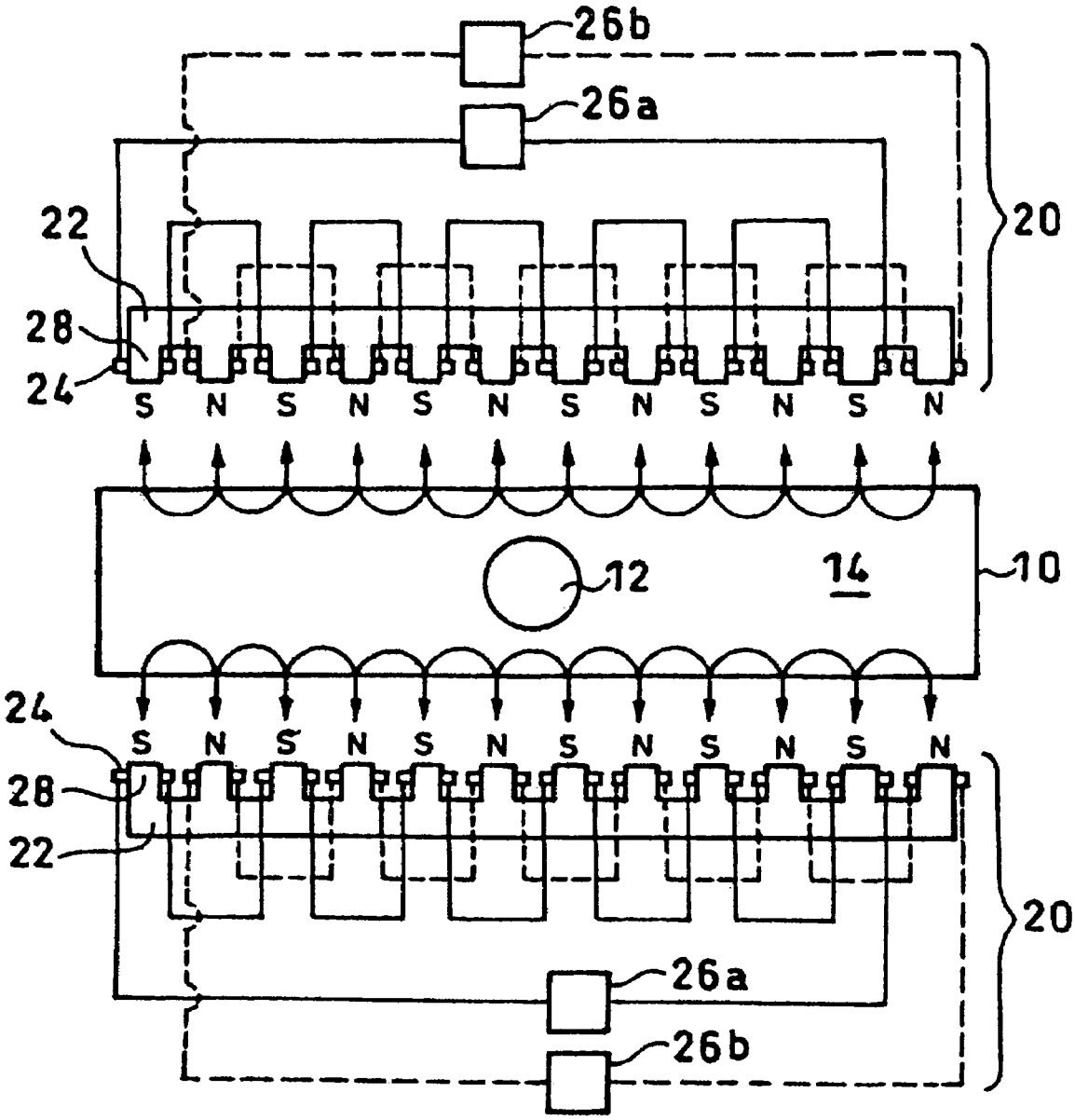
FIG. 19 is a schematic horizontal sectional view of a continuous casting apparatus used in a first embodiment.

FIG. 19 is a schematic horizontal sectional view of a continuous casting apparatus suitably used in the embodiment of the present invention. In FIG. 19, reference numerals 10 represents a mold; 12, an immersion nozzle; 14, a molten steel; 20, a vibrating magnetic field generator; 22, a sinking comb-shaped iron core; 24, AC coils; 26*a* and 26*b*, AC power sources; 28, magnetic poles.

In the present invention, continuous casting is performed while an electromagnetic field is applied to the molten steel 14 in the mold 10 having opposing wide faces and opposing narrow faces. The applied magnetic field vibrates in the longitudinal direction of the mold 10 (that is, a vibrating magnetic field is applied). The vibrating magnetic field is an alternating magnetic field applied in the longitudinal direction of the mold 10, and the direction of the magnetic field is periodically reversed; hence, the vibrating magnetic field does not induce any macroscopic flow of the molten steel 14.

The vibrating magnetic field can be generated by use of, for example, a vibrating magnetic field generator 20 shown in FIG. 19. In the vibrating magnetic field generator 20, a sinking comb-shaped iron core 22 is used which has at least three (twelve in FIG. 19) teeth aligned in the longitudinal direction of the mold 10. AC coils 24 are provided to the teeth to define magnetic poles 28. The winding direction of the AC coils and the alternating current passing through the AC coils are selected so that each magnetic pole 28 has a different polarity (N or S) from the adjacent magnetic poles 28. In order for adjacent magnetic poles to have different polarities (N or S) from each other, the AC coils of the adjacent magnetic poles 28 are wound in opposite directions to each other and an alternating current having a predetermined frequency is passed through the AC coils with the same phase in the coils, or the AC coils of the adjacent magnetic poles 28 are wound in the same direction and alternating currents having a predetermined frequency are passed through the coils so that the currents in the adjacent magnetic poles are out of phase with each other. The alternating current phases in AC coils of adjacent magnetic poles 28 are shifted so as to be substantially reversed, and specifically by an angle in the range of 130° to 230°.

The predetermined frequency of the alternating current is preferably in the range of 1 to 8 Hz, and more preferably 3 to 6 Hz. FIG. 19 shows an example in which the AC coils of adjacent magnetic poles 28 are wound in the same direction and alternating currents having different phases (substantially reversed phases) are passed through the adjacent AC coils, but the invention is not limited to this example.

Since, in the present invention, any two adjacent magnetic poles 28 have different polarities from each other, the direction of an electromagnetic force acting on the molten steel 14 between a pair of two adjacent magnetic poles 28 is substantially opposite to that of the electromagnetic force acting on the molten steel 14 between the adjacent pair of magnetic poles 28. No macroscopic flow is therefore induced in the molten steel 14. In the present invention, since alternating current passes through the AC coils, the polarity of each magnetic pole 28 can be reversed at predetermined intervals to induce vibration of the molten steel 14 in the longitudinal direction of the mold 10 in the vicinities of solidification interfaces. Thus, the entrapment of inclusions and air bubbles at the solidification interfaces can be prevented to improve the surface quality of cast slabs.

An alternating current frequency of less than 1 Hz is so low as not to induce sufficient flows of the molten steel. In contrast, an alternating current frequency of more than 8 Hz does not allow the molten steel 14 to follow the vibrating magnetic field and, thus, reduces the effect by applying the magnetic field. It is therefore preferable that the frequency of the alternating current passing through the AC coils be set in the range of 1 to 8 Hz, and that the vibration cycle of the vibrating magnetic field be set in the range of ⅛ to 1 s.

Preferably, the magnetic flux density of the vibrating magnetic field is less than 1,000 G, in the present invention. A magnetic flux density of 1,000 G or more not only fractures dendrite, but also largely varies the bath level, and consequently helps the entrainment of mold flux.

In addition to the vibrating magnetic field, a static magnetic field may be applied, in the present invention. The static magnetic field is applied in the widthwise direction of the mold 10 (thickness direction of the cast slab) with static magnetic field generators 30 disposed at the wide face sides of the mold 10, as shown in FIG. 20.

By applying a static magnetic field in the widthwise direction of the mold 10, the molten flow rate around the center of the mold 10 can be reduced to prevent the entrainment of mold flux. Also, by superimposing the static magnetic field on the vibrating magnetic field, term B of the equation $F=J\times B$ can be increased, and the Lorentz force can be further increased accordingly.

Preferably, the magnetic flux density of the applied static magnetic field is in the range of 200 G more and 3,000 G or less, in the present invention. A magnetic flux density of less than 200 G lowers the effect of reducing the molten flow rate, and, in contrast, a magnetic flux density of more than 3,000 G results in such a high braking force as to cause heterogeneous solidification.

Figure 20:
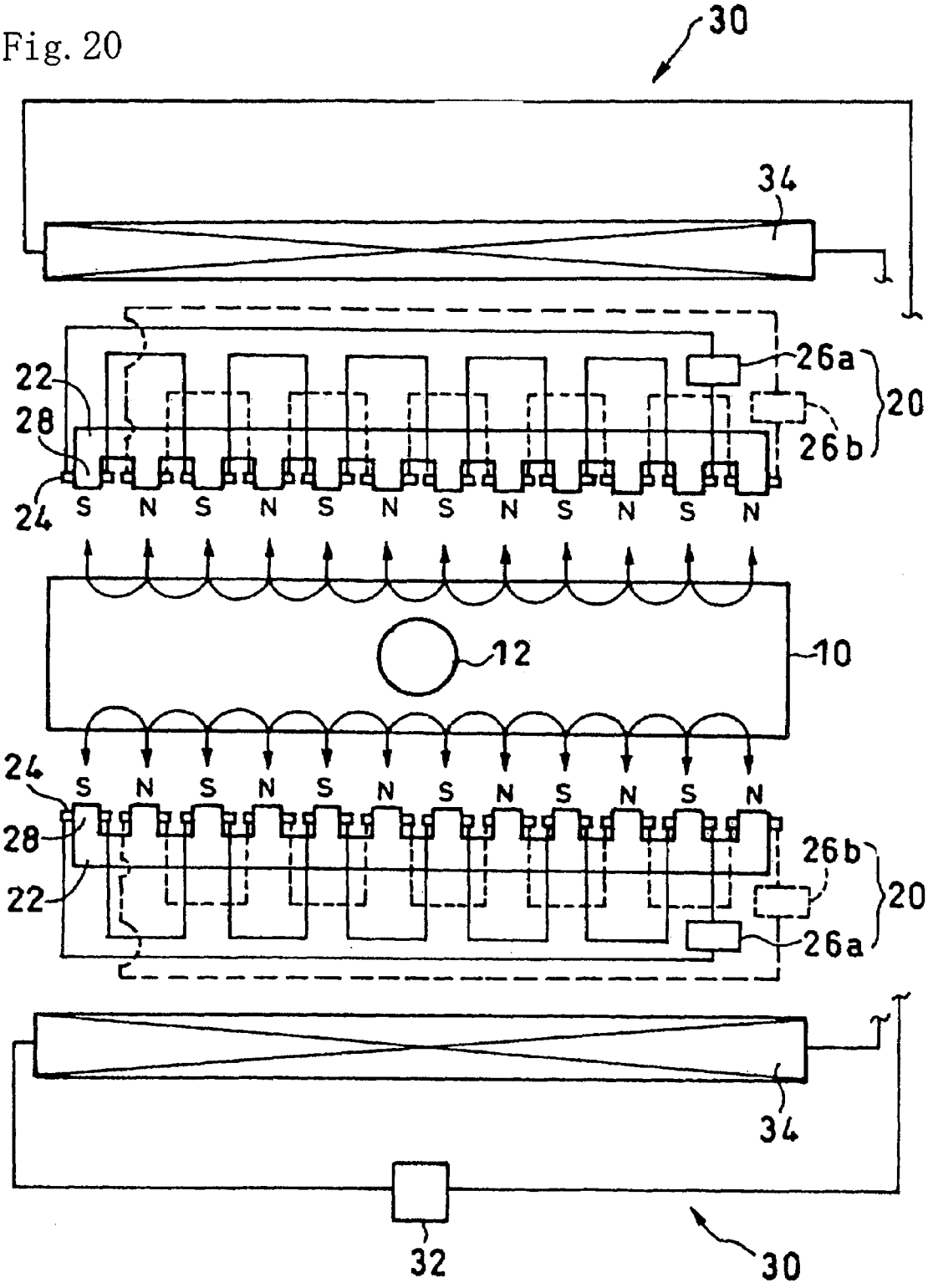
FIG. 20 is a schematic horizontal sectional view of a continuous casting apparatus used in a second embodiment.

FIG. 20 shows an arrangement in which vibrating magnetic field generators 20 and static magnetic field generators 30 are disposed at the wide face sides of the mold 10. A pair of the static magnetic field generators 30 are disposed at the wide face sides of the mold 10 with the mold 10 therebetween, and a DC power source 32 applies a direct current to DC coils 34 to apply static magnetic fields in the widthwise direction of the mold 10 (thickness direction of the cast slab). The vertical positions of the static magnetic field generator 30 and the vibrating magnetic field generator 20 may be the same or different.

The following description illustrates a case where a traveling magnetic field is applied and a case where the peak positions of a vibrating magnetic field is locally shifted in the longitudinal direction of the mold 10.

Figure 14:
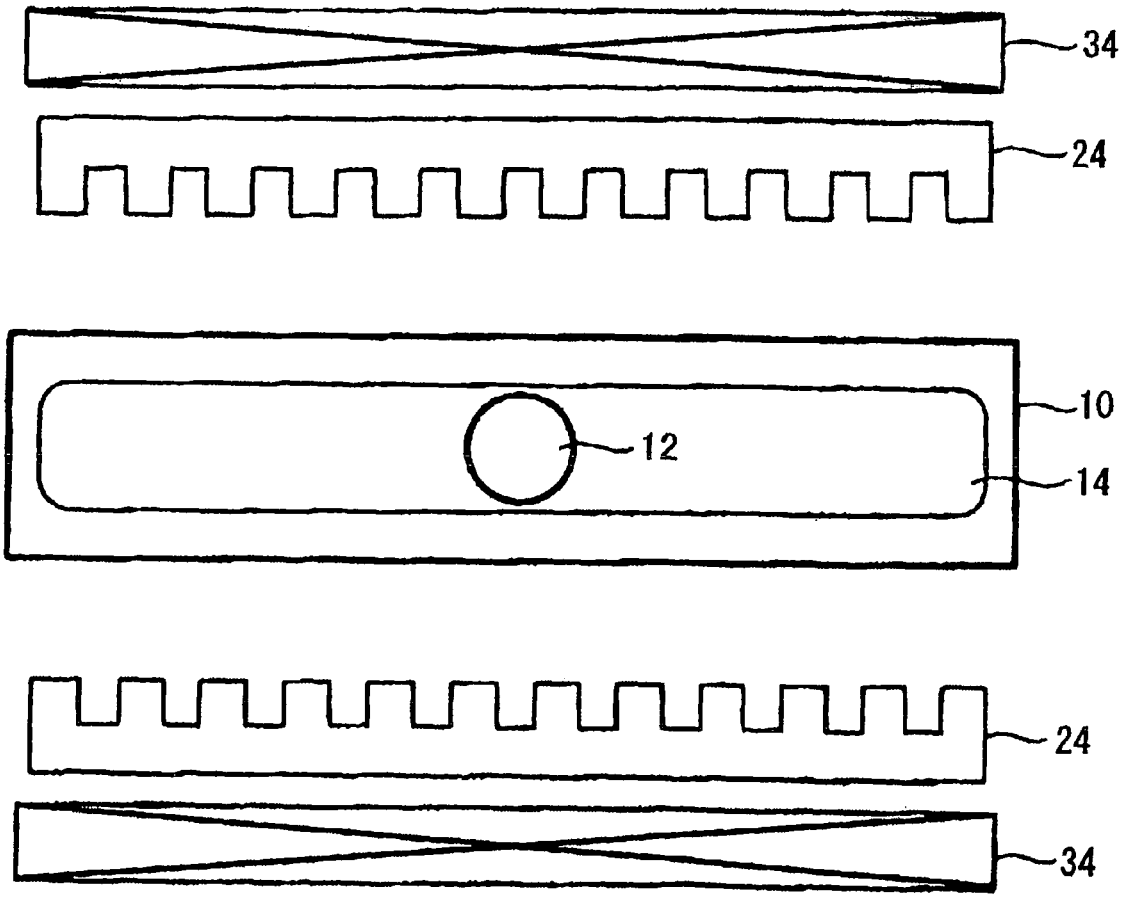
FIG. 14 is a schematic plan view of an arrangement of AC coils, DC coils, and a mold.

FIG. 14 shows a plan view of the mold 10 and an arrangement of the AC electromagnets (AC coils 24) and the DC electromagnets (DC coils 34).

A molten steel 14 is fed into the mold 10 from an immersion nozzle 12 connected to the bottom of a tundish (not shown in the figure) provided above the mold. Twelve sinking comb-shaped AC electromagnets (AC coils 24) are disposed along each wide face of the mold 10, and a DC coil 34 is disposed outside the twelve AC electromagnets, in the same manner as in FIG. 20. Vibrating current for generating a vibrating magnetic field is applied to each of the twelve AC coils 24 so that peak values of the vibrating current shift along the longitudinal direction of the mold 10. For the shift of the peak values, the current is applied so that the arrangement of coil phases has a part where phases of three adjacent AC coils are in the order of n, 2n, and n or n, 3n, and 2n.

FIGS. 15 to 18 show the distributions of the phases of a vibrating magnetic field at a certain time at two sets 24*a* and 24*b* of twelve AC coils. The phases are represented by numerals (phase angles). Peak positions of the vibrating magnetic field are gradually shifted in the longitudinal direction of the mold 10.

Figure 15:
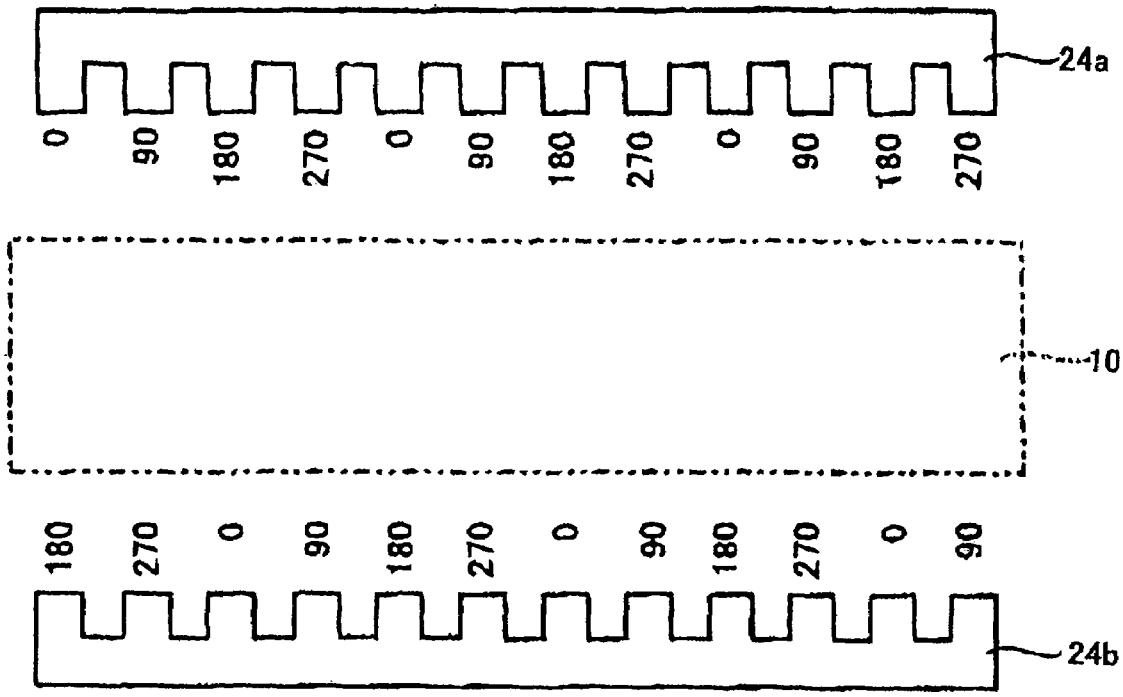
FIG. 15 is a schematic illustration showing phases of AC coils when a traveling magnetic field is applied.
Figure 16:
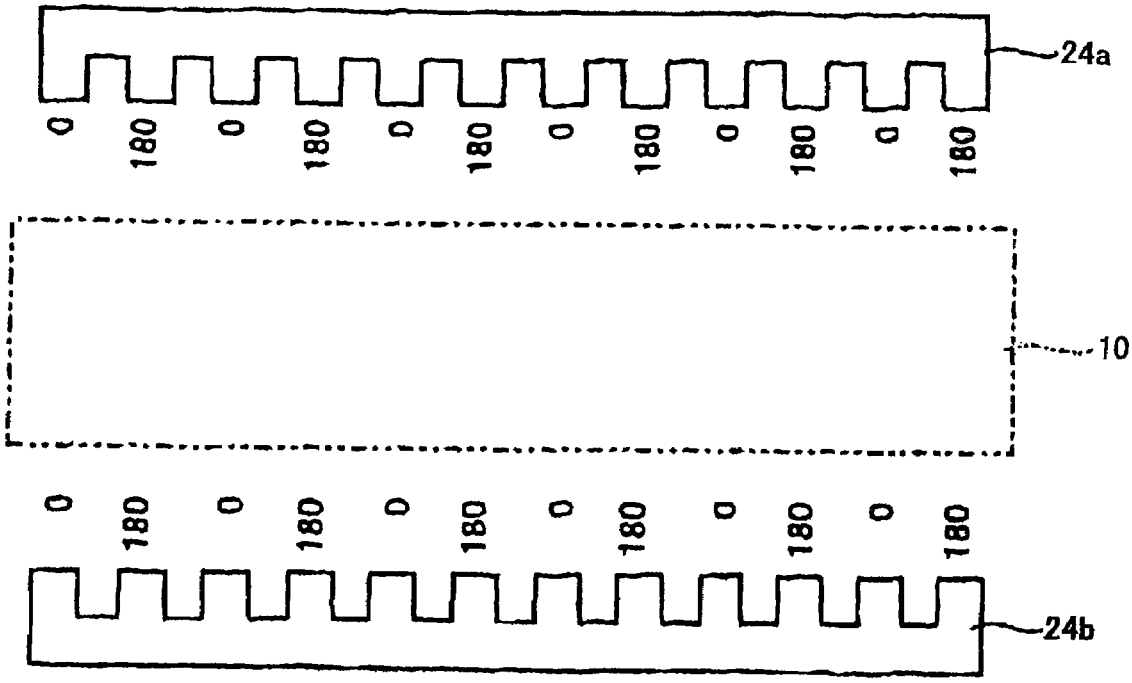
FIG. 16 is a schematic illustration showing phases of AC coils when a vibrating magnetic field is applied.
Figure 17:
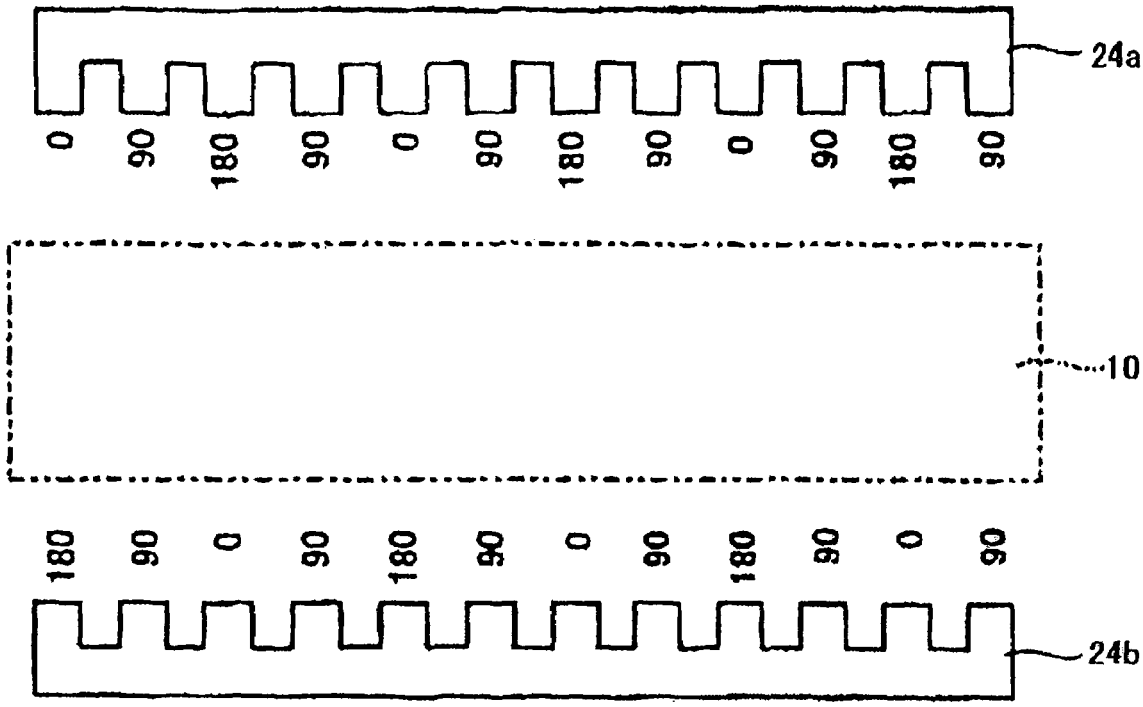
FIG. 17 is a schematic illustration showing phases of AC coils when peak positions of a vibrating magnetic field are locally shifted.
Figure 18:
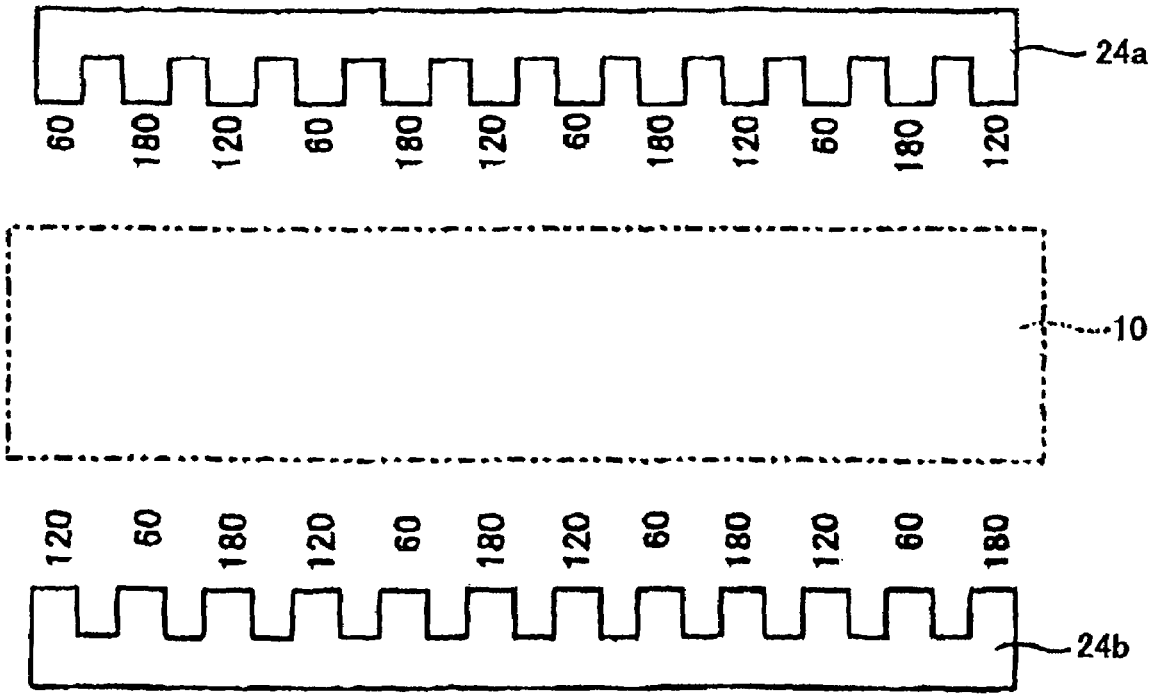
FIG. 18 is another schematic illustration showing phases of AC coils when peak positions of a vibrating magnetic field are locally shifted.

FIG. 15 shows a case where a two-phase alternating traveling magnetic field is applied which has a phase difference of 90° between any two adjacent AC coils and a phase difference of 180° between any two opposing AC coils 24*a* and 24*b*. FIG. 16 shows a case where a two-phase alternating vibrating magnetic field is applied which has a phase difference of 180° between any two adjacent AC coils and the same phase between any two opposing AC coils 24*a* and 24*b*. FIG. 17 shows a case where a half-wave rectified two-phase alternating magnetic field is applied which has a phase difference of 90° between any two adjacent AC coils and a phase difference of 180° between any two opposing AC coils 24*a* and 24*b*. FIG. 18 shows a case where a half-wave rectified three-phase alternating magnetic field is applied which has a phase difference of 120° between any two adjacent AC coils and a phase difference of 60° between any two opposing AC coils.

Figure 23:
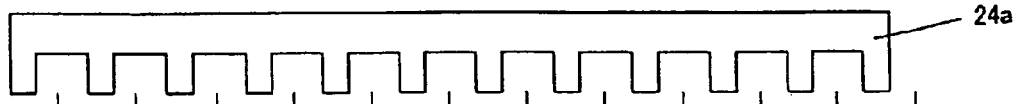
FIG. 23 is a diagram of the changes in phase with time of current generating a traveling magnetic field.
Figure 24:
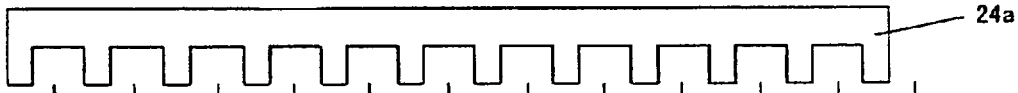
FIG. 24 is a diagram of the changes in phase with time of current locally shifting peak positions of a vibrating magnetic field.
Figure 25:
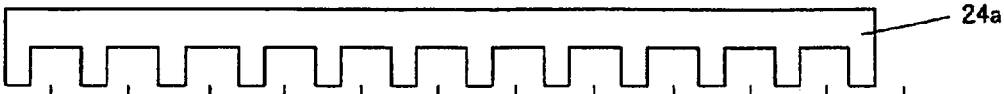
FIG. 25 is another diagram of the changes in phase with time of current locally shifting peak positions of a vibrating magnetic field.

FIG. 23 shows the changes in phase with time of the traveling magnetic field shown in FIG. 15, corresponding to the AC coils 24*a*. The top row has the same arrangement of phase angles as in FIG. 15. The downward direction represents time passage. FIGS. 24 and 25 respectively show the local shifts of the peak positions of the vibrating magnetic fields shown in FIGS. 17 and 18, in the same manner as above.

As described above, by locally shifting the peak positions of the vibrating magnetic field, only the solidification interfaces can be efficiently vibrated to prevent the entrapment of air bubbles and inclusions. Thus, the surface quality of the resulting cast slab can be significantly improved.

A second embodiment in which static magnetic field is superimposed on vibrating magnetic field will now be described in detail with reference to the drawings.

FIG. 20 is a schematic horizontal sectional view of a continuous casting apparatus suitably used in the embodiment of the present invention. FIG. 20 shows an arrangement in which static magnetic field generators 30 are added to the arrangement shown in FIG. 19.

In the present embodiment, the continuous casting is performed while electromagnetic fields are applied to the molten steel in the mold 10 having opposing wide faces and opposing narrow faces. The applied magnetic fields are a magnetic field vibrating in the longitudinal direction of the mold 10 (that is, a vibrating magnetic field) and a static magnetic field in the thickness direction. The vibrating magnetic field is an alternating magnetic field applied in a longitudinal direction of the mold 10, and the direction of the magnetic field is periodically reversed; hence, the vibrating magnetic field does not induce any macroscopic flow of the molten steel 14.

The vibrating magnetic field is generated by use of, for example, a vibrating magnetic field generator 20 shown in FIG. 20. The vibrating magnetic field generator 20 shown in FIG. 20 has substantially the same structure as in FIG. 19 for the first embodiment, and the detailed description is omitted.

In addition to the vibrating magnetic field applied as in the first embodiment, a static magnetic field is applied, in the present embodiment. The static magnetic field is applied in the widthwise direction of the mold 10 (thickness direction of the cast slab) with static magnetic field generators 30 disposed at the wide face sides of the mold 10, as shown in FIG. 20.

By applying a static magnetic field in the widthwise direction of the mold 10, the molten flow rate around the center of the mold 10 can be reduced to prevent the entrainment of mold flux. Also, by superimposing the static magnetic field on the vibrating magnetic field, term B of the equation $F=J\times B$ can be increased, and the Lorentz force can be further increased accordingly.

Preferably, the magnetic flux density of the applied static magnetic field is in the range of 200 G more and 3,000 G or less, in the present invention. A magnetic flux density of less than 200 G lowers the effect of reducing the molten flow rate, and, in contrast, a magnetic flux density of more than 3,000 G results in such a high braking force as to cause heterogeneous solidification.

FIG. 20 shows an arrangement in which vibrating magnetic field generators 20 and static magnetic field generators 30 are disposed at the wide face sides of the mold 10. A pair of magnetic poles 28 of the static magnetic field generators 30 are disposed at the wide face sides of the mold 10 with the mold 10 therebetween, and a DC power source 32 applies a direct current to DC coils 34 to apply static magnetic fields in the widthwise direction of the mold 10. The vertical positions of the static magnetic field generator 30 and the vibrating magnetic field generator 20 may be the same or different.

A third embodiment will now be described in detail with reference to the drawings. In the third embodiment, the peak positions of a vibrating magnetic field are locally shifted in the longitudinal direction of the mold 10.

FIG. 14 shows a plan view of the mold 10 and an arrangement of the AC electromagnets (AC coils 24) and the DC electromagnets (DC coils 34).

A molten steel 14 is fed into the mold 10 from an immersion nozzle 12 connected to the bottom of a tundish (not shown in the figure) provided above the mold. Twelve sinking comb-shaped AC electromagnets (AC coils 24) are disposed along each wide face of the mold 10, and a DC coil 34 is disposed outside the twelve AC electromagnets, in the same manner as in FIG. 20. Vibrating current for generating a vibrating magnetic field is applied to each of the twelve AC coils 24 so that peak values of the vibrating current shift along the longitudinal direction of the mold 10. For the shift of the peak values, the current is applied so that the arrangement of coil phases has a part where phases of three adjacent AC coils are in the order of n, 2n, and n or n, 3n, and 2n.

FIGS. 15 to 18 show the distributions of the phases of a vibrating magnetic field at a certain time at two sets 24*a* and 24*b* of twelve AC coils. The phases are represented by numerals (phase angles). Peak positions of the vibrating magnetic field are gradually shifted in the longitudinal direction of the mold 10.

FIG. 15 shows a case where a two-phase alternating traveling magnetic field is applied which has a phase difference of 90° between any two adjacent AC coils and a phase difference of 180° between any two opposing AC coils 24*a* and 24*b*. FIG. 16 shows a case where a two-phase alternating vibrating magnetic field is applied which has a phase difference of 180° between any two adjacent AC coils and the same phase between any two opposing AC coils 24*a* and 24*b*. FIG. 17 shows a case where a half-wave rectified two-phase alternating magnetic field is applied which has a phase difference of 90° between any two adjacent AC coils and a phase difference of 180° between any two opposing AC coils 24*a* and 24*b*. FIG. 18 shows a case where a half-wave rectified three-phase alternating magnetic field is applied which has a phase difference of 120° between any two adjacent AC coils and a phase difference of 60° between any two opposing AC coils.

As described above, by locally shifting the peak positions of the vibrating magnetic field, only the solidification interfaces can be efficiently vibrated to prevent the entrapment of air bubbles and inclusions in continuous casting without gas blowing as in the first embodiment. Thus, the surface quality of the resulting cast slab can be significantly improved.

A fourth embodiment in which the interaction between the Lorentz force and the molten steel flow rate is suitably maintained will now be described in detail.

In the fourth embodiment, the molten steel flow rate V (m/s) in the mold 10 and the maximum Lorentz force $F_{max}$ ($N/m^3$) induced by a magnetic field are set so that $V \times F_{max}$ is in the range of 3,000 $N/(s \cdot m^2)$ or more and 6,000 $N/(s \cdot m^2)$ or less.

Although the molten steel flow rate V should be obtained by measurement, the following regression equation, which is obtained from experiments by the inventors, may be substituted if the measurement is difficult:

$$V(\text{m/sec})=(43.0-0.047L_{SEN}+0.093\theta+10.0Q+0.791q_{Ar}-0.0398W)/100$$

Where $L_{SEN}$: depth of nozzle immersion (mm); Q: molten steel feeding rate (t/min); θ: spout angle of immersion nozzle (°); $q_{Ar}$: blowing gas flow rate through nozzle (L/min); W: mold width (mm).

Figure 26:
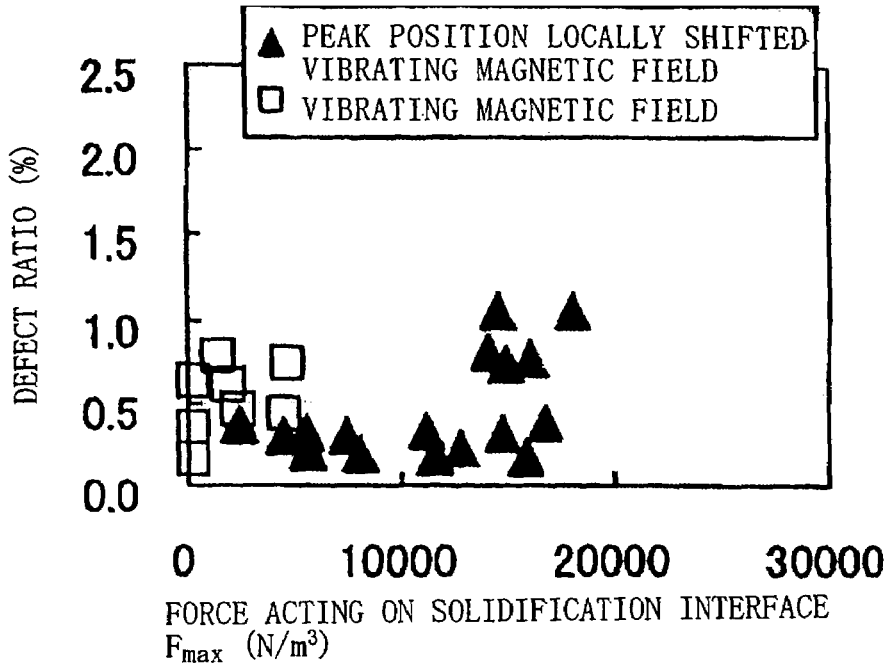
FIG. 26 is a plot showing the relationship between the maximum Lorentz force $F_{max}$ and the ratio of the number of defects to the number of total products.
Figure 34:
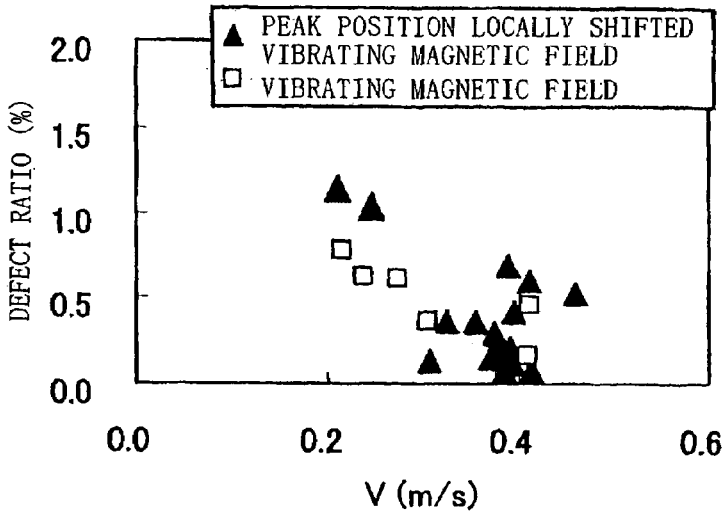
FIG. 34 is a plot showing the relationship between the molten steel flow rate V and the ratio of the number of defects to the number of total products.
Figure 35:
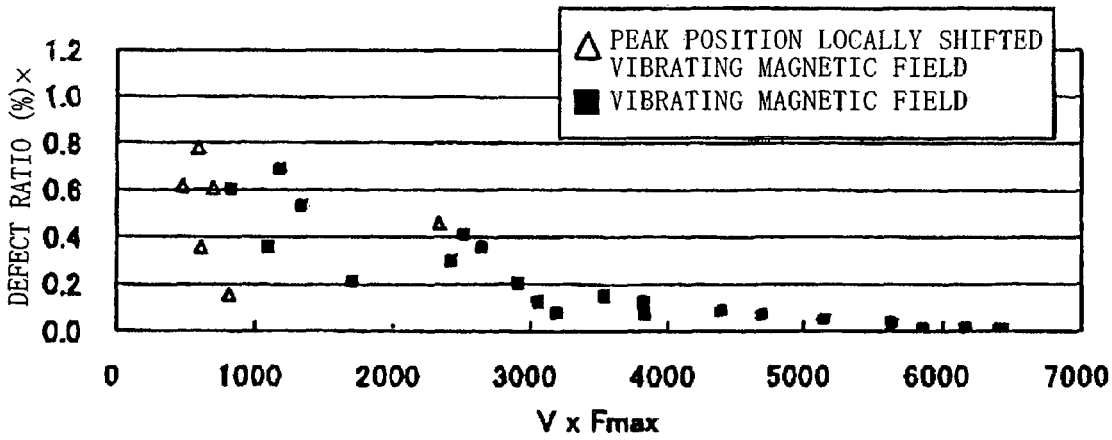
FIG. 35 is a plot showing the relationship between the values of $V \times F_{max}$ and the ratio of the number of defects to the number of total products.

FIG. 34 shows the relationship between the defect ratio and the rate of molten steel flows induced by a magnetic field, obtained from the continuous casting according to the first embodiment. The defect ratio is represented by a ratio of the number of defects to the number of total products. The relationship between the defect ratio and the maximum Lorentz force is shown in FIG. 26. These results were investigated in detail and it has been found that setting $V \times F_{max}$ to be 3,000 or more is effective at reducing the defect ratio, as shown in FIG. 35. It has also been found that $V \times F_{max}$ values of more than 6,000 lead to the same effect.

While the iron core is a sinking comb-shaped core and the number of magnetic poles of the iron core is twelve in the embodiments, the number of magnetic poles and the shape of the iron core are not limited to those of the embodiments. For example, the iron core may be divided. Also, a static magnetic field is not necessary superimposed. For example, the DC coils 34 may be removed from the apparatus shown in FIG. 20.

EXAMPLES

First Example

First, an exemplary molten steel 14 will be described. After being taken out of a converter, 300 t of molten steel 14 was decarburized with an RH vacuum degassing apparatus so that the molten steel composition contains 0.0035% by mass of C, 0.02% by mass of Si, 0.20% by mass of Mn, 0.015% by mass of P, and 0.010% by mass of S, and the temperature of the molten steel was adjusted to 1,600° C. To the molten steel 14 was added 0.5 Kg/t of Al to reduce the dissolved oxygen concentration of the molten steel 14 to 150 ppm. In this instance, the Al content in the molten steel 14 was 0.003% by mass. Then, 1.2 kg/t of Ti(70% by mass)—Fe alloy was added to the molten steel 14 to deoxidize. Subsequently, 0.5 kg/t of Ca (20% by mass)—REM (10% by mass)—Ti (50% by mass)—Fe alloy was added to the molten steel 14 to adjust the composition. The Ti content in the resulting molten steel was 0.050% by mass; the Al content, 0.003% by mass.

Then, casting experiments were performed with the continuous casting apparatus shown in FIG. 19. The inclusions in the tundish (not shown in the figure) were analyzed and it was found that the inclusions were spherical and contained 65% by mass of $Ti_2O_3$, 15% by mass of CaO, 10% by mass of $Ce_2O_3$, and 10% by mass of $Al_2O_3$. After the casting, deposits were hardly observed in the immersion nozzle.

In the example, the dimensions of the slab were 1,500 to 1,700 mm in width and 220 mm in thickness, and the throughput of the molten steel 14 was set in the range of 4 to 5 t/min.

For coils, the sinking comb-shaped iron cores, each having 12 equal teeth aligned in the width direction of the cast slab, as shown in FIG. 1, were used. The coils were arranged so as to generate magnetic fields whose phases were reversed alternately in the width direction of the cast slab (that is, vibrating magnetic field).

Figure 21:
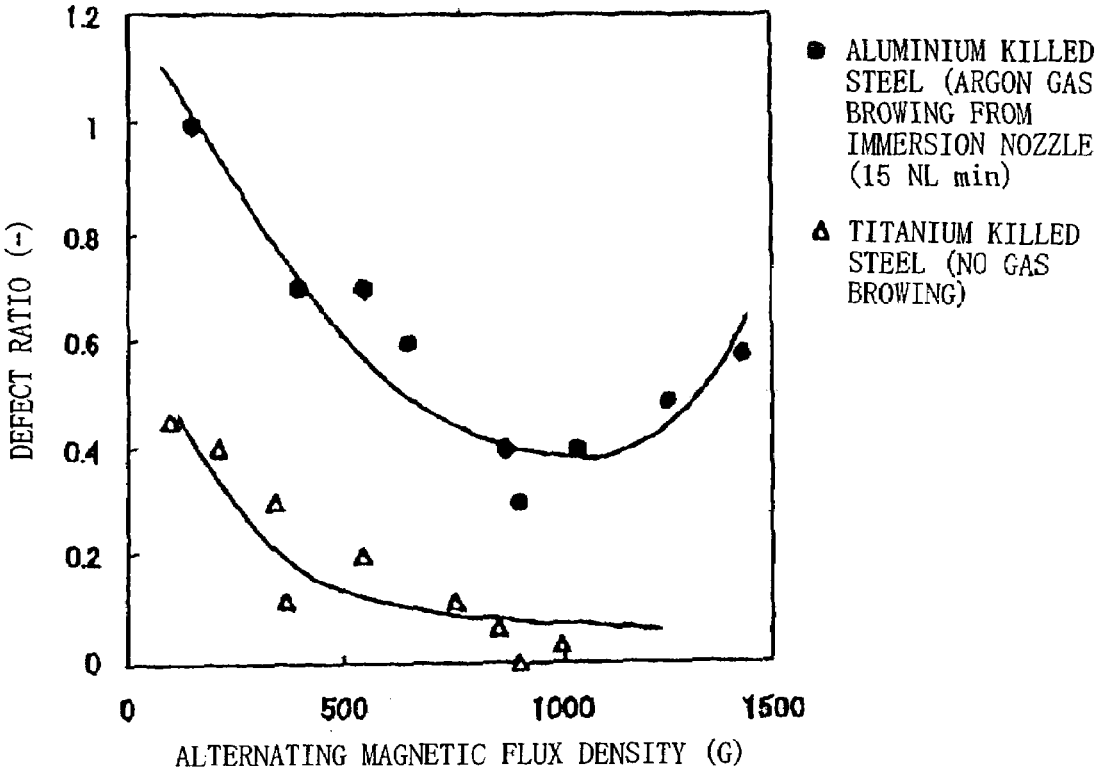
FIG. 21 is a plot showing effects of the present invention.

FIG. 21 shows the experimental conditions and experimental results (defect ratio) together for an ultra low carbon steel. In FIG. 21, defects resulting from entrapment of the inclusions and entrainment of mold flux, blowholes, and surface defects were counted for calculation of the defect ratio.

For surface segregation of the cast slab, after the resulting slab was cut and grinded, and then etched, the number of segregated portions per square meter was visually counted. In addition, the slab was cold-rolled and the resulting cold rolled coil was visually observed for surface defects. Defective portions were sampled, and analyzed to obtain the number of defects resulting from mold flux. Inclusions were extracted from the position of ¼ of the thickness by the slime extraction and weighed. The surface segregation, defects resulting from mold flux, and the weight of inclusions were each expressed by a linear ratio to the worst result, which is assumed to be 10.

FIG. 21 suggests that the surface segregation, defects resulting from entrainment of mold flux, blowholes, and non-metal inclusions can be reduced depending on alternating magnetic flux density.

In this instance, probably, a high intensity of the vibrating magnetic field increases the entrainment of flux of the surface of the molten steel to degrade the surface quality, and an excessively high frequency makes it difficult that the molten steel follows the magnetic field, thus reducing the effect of cleaning the solidification interfaces to increase defects resulting from blowholes or inclusions.

While the iron core is a sinking comb-shaped core and the number of magnetic poles of the iron core is twelve in the present example, the number of magnetic poles and the shape of the iron core are not limited to those of the example. For example, the iron core may be divided.

Second Example

A slab was made of the same molten steel 14 prepared in a converter as in the first example, with the continuous casting apparatus shown in FIG. 20. In this instance, the dimensions of the slab were 1,500 to 1,700 mm in width and 220 mm in thickness, and the throughput of the molten steel 14 was set in the range of 4 to 5 t/min, as in above.

Figure 6:
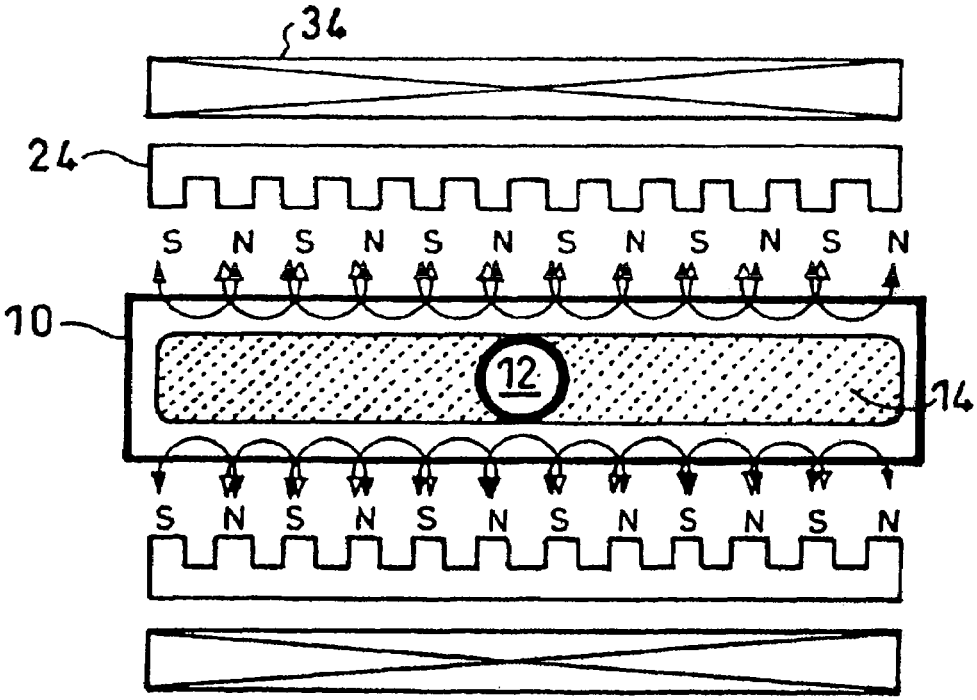
FIG. 6 is a schematic horizontal sectional view of another combination of electromagnets and a mold used in the present invention.
Figure 7:
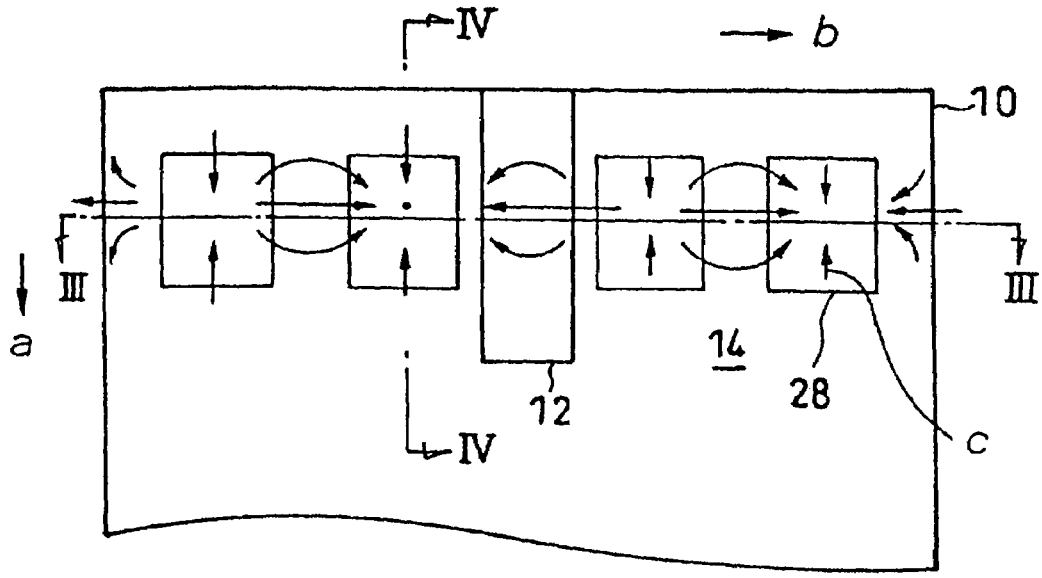
FIG. 7 is a schematic front view for explaining the principle of the present invention, showing velocity vectors at a certain time of molten steel flows induced by magnetic fields, the velocity vectors according to calculating analyses of the magnetic fields and the flows.
Figure 8:
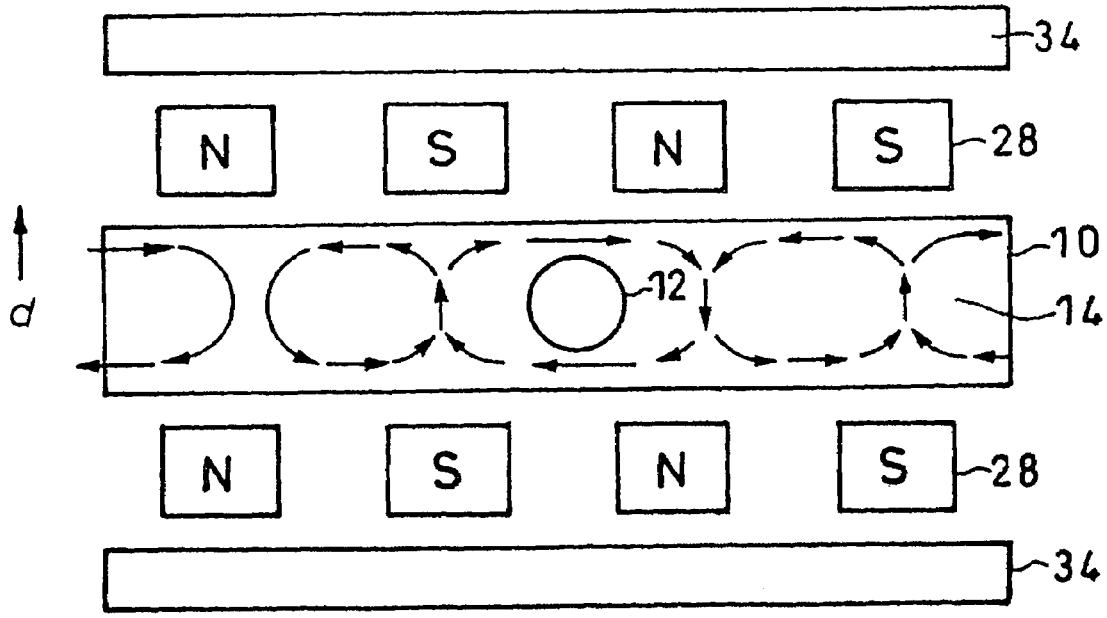
FIG. 8 is a horizontal sectional view taken along line III-III in FIG. 7.
Figure 9:
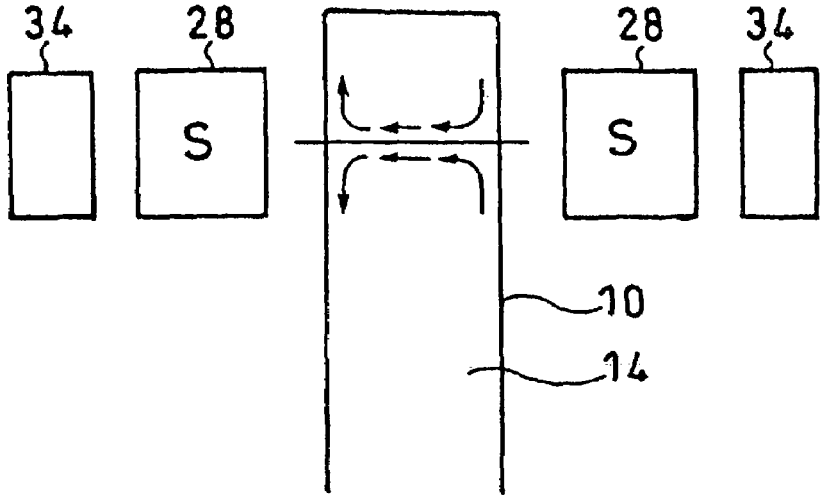
FIG. 9 is a vertical sectional view taken along line IV-IV in FIG. 7.
Figure 10:
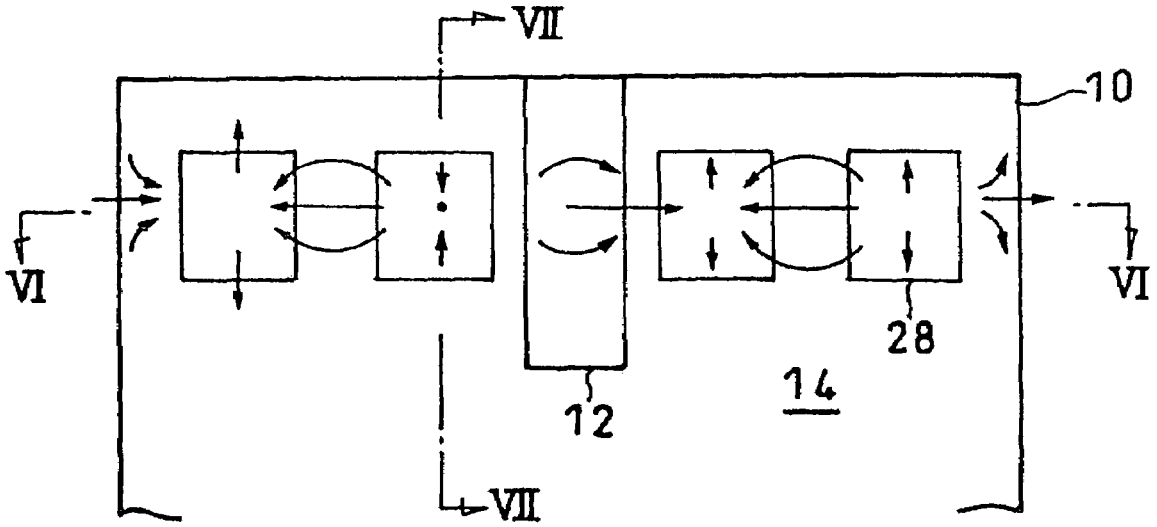
FIG. 10 is a schematic front view for explaining the principle of the present invention, showing velocity vectors of molten steel flows induced by magnetic fields at a time subsequent to a time when magnetic poles are reversed, the velocity vectors according to calculating analyses of the magnetic fields and the flows.
Figure 11:
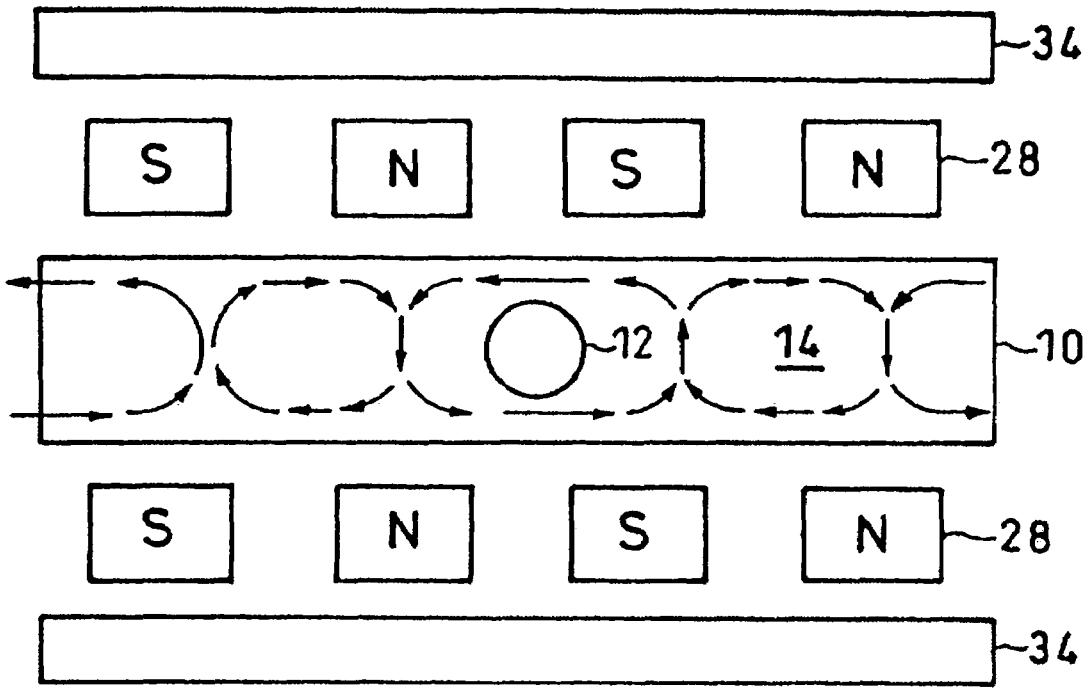
FIG. 11 is a horizontal sectional view taken along line VI-VI in FIG. 10.
Figure 12:
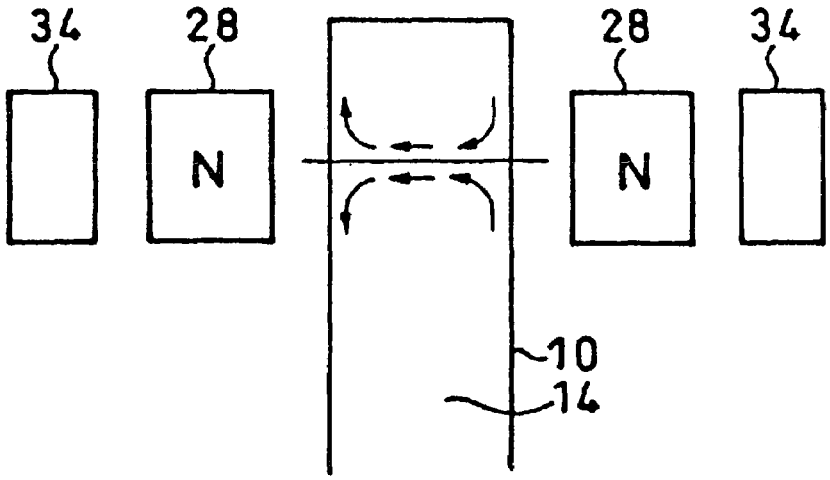
FIG. 12 is a vertical sectional view taken along line VII-VII in FIG. 10.
Figure 13:
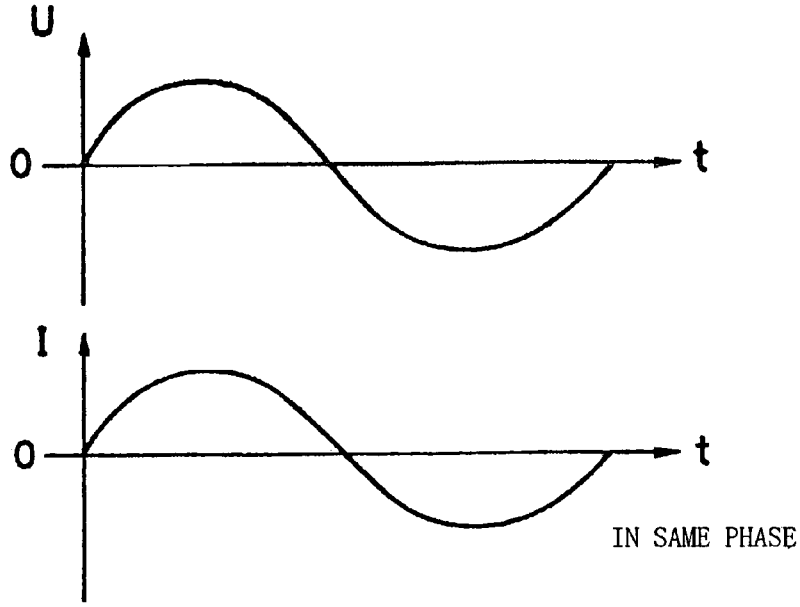
FIG. 13 is a diagram showing the changes in applied current and molten steel flow rate with time according to the present invention.

For coils, the sinking comb-shaped iron cores, each having 12 equal teeth aligned in the width direction of the cast slab, as shown in FIG. 6, were used. The coils were arranged so as to generate magnetic fields whose phases were reversed alternately in the width direction of the cast slab (that is, vibrating magnetic field).

Figure 22:
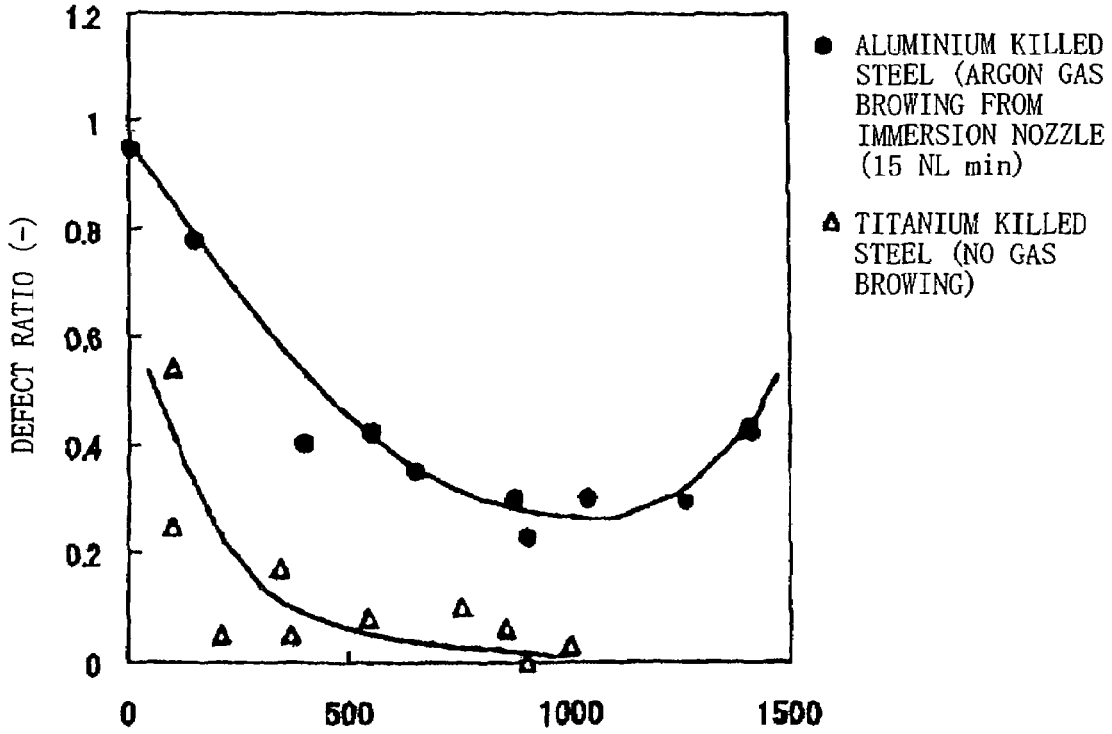
FIG. 22 is a plot showing effects by superimposing a static magnetic field of the present invention.

FIG. 22 shows the conditions and results of experiments performed on an ultra low carbon steel in a direct-current magnetic field having a constant magnetic flux density of 1,200 G. The experimental results shown in FIG. 22 were obtained through the same analytical procedures as in the first embodiment.

FIG. 22 suggests that the surface segregation, defects resulting from entrainment of mold flux, blowholes, and non-metal inclusions can be reduced by superimposing a static magnetic field on a vibrating magnetic field.

In this case also, probably, a high intensity of the vibrating magnetic field increases the entrainment of flux of the surface of the molten steel to degrade the surface quality, and an excessively high frequency makes it difficult that the molten steel follows the magnetic field, thus reducing the effect of cleaning the solidification interfaces to increase defects resulting from blowholes or inclusions.

Third Example

For coils, the sinking comb-shaped iron cores, each having 12 equal teeth aligned in the width direction of the cast slab, as shown in FIG. 14, were used. The coils were arranged so as to generate magnetic fields whose phases were reversed alternately in the width direction of the cast slab (that is, vibrating magnetic field). The magnetic flux of the alternating magnetic field was set 1,000 G at the maximum.

Table 1 shows experimental conditions and experimental results together. The experimental results were obtained through the same analytical procedures as in the first embodiment. The alphabetical signs for coil phase patterns in Table 1 designate as follows:

A: n, 2n, n (Example);

B: n, 3n, 2n (Example);

C: 0, n, 2n, 3n (Comparative Example); and

D: 0, 2n, 0, 2n (Comparative Example), where n represents a phase angle: n=90° for two-phase alternating current; n=60° or 120° for three-phase alternating current.

Table 1 suggests that the surface segregation, defects resulting from entrainment of mold flux, blowholes, and non-metal inclusions can be reduced by applying a vibrating magnetic field.

As in the first embodiment, probably, a high intensity of the vibrating magnetic field increases the entrainment of flux of the surface of the molten steel to degrade the surface quality, and an excessively high frequency makes it difficult that the molten steel follows the magnetic field, thus reducing the effect of cleaning the solidification interfaces to increase defects resulting from blowholes or inclusions.

Fourth Example

About 300 t of molten steel 14 was prepared in a converter, and subjected to RH treatment to prepare an ultra low carbon Al killed steel. The killed steel was cast into a slab with a continuous casting apparatus. An exemplary molten steel composition is shown in Table 2. The dimensions of the slab were 1,500 to 1,700 mm in width and 220 mm in thickness, and the throughput of the molten steel 14 was set in the range of 4 to 5 t/min.

For coils, the sinking comb-shaped iron cores, each having 12 equal teeth aligned in the width direction of the cast slab, as shown in FIGS. 6 and 14, were used. The coils were arranged so as to generate magnetic fields whose phases were periodically varied in the width direction of the cast slab (that is, vibrating magnetic field).

TABLE 2

| C | Si | Mn | P | S | Al | Ti |
|---|---|---|---|---|---|---|
| 0.0015 | 0.02 | 0.08 | 0.015 | 0.004 | 0.04 | 0.04 |

Continuous casting was thus performed. The defect ratios, blowholes, and slag patches in the resulting slabs were shown in FIGS. 26, 27, and 28.

The defect ratios in the figures were defined by the ratio in percent of the number of defects resulting from air bubbles and inclusions to the entire length of the cold-rolled coil after cold rolling, wherein the number of defects is expressed in meter, assuming one defect to be 1 m. For counting blowholes and slag patches, the resulting cast slab was cut out and the surface of the slab was scarfed to expose holes at the surface. Hollow holes were counted as blowholes, and holes filled with mold flux were counted as slag patches. The counts were each divided by the surface area of the tested cast slab.

Figure 27:
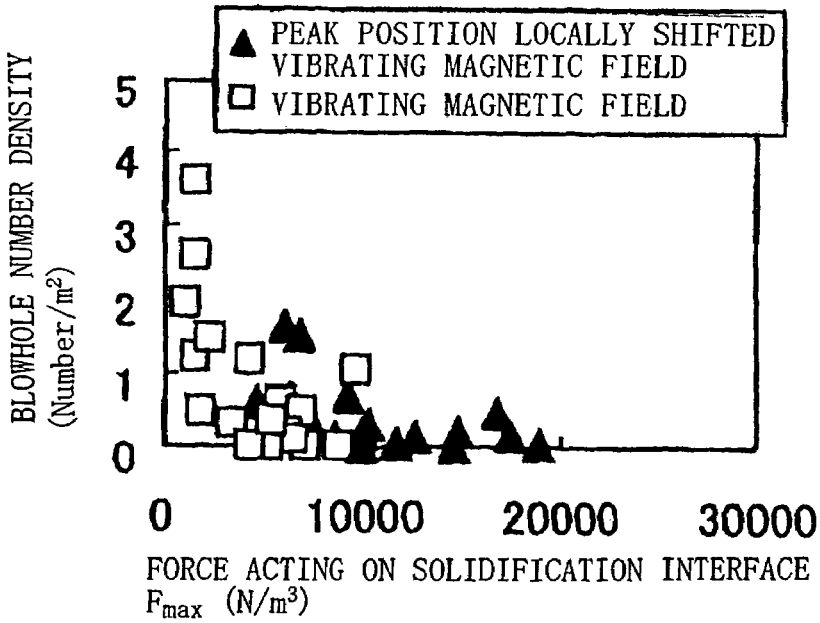
FIG. 27 is a plot showing the relationship between the maximum Lorentz force $F_{max}$ and the number density of blowholes.
Figure 28:
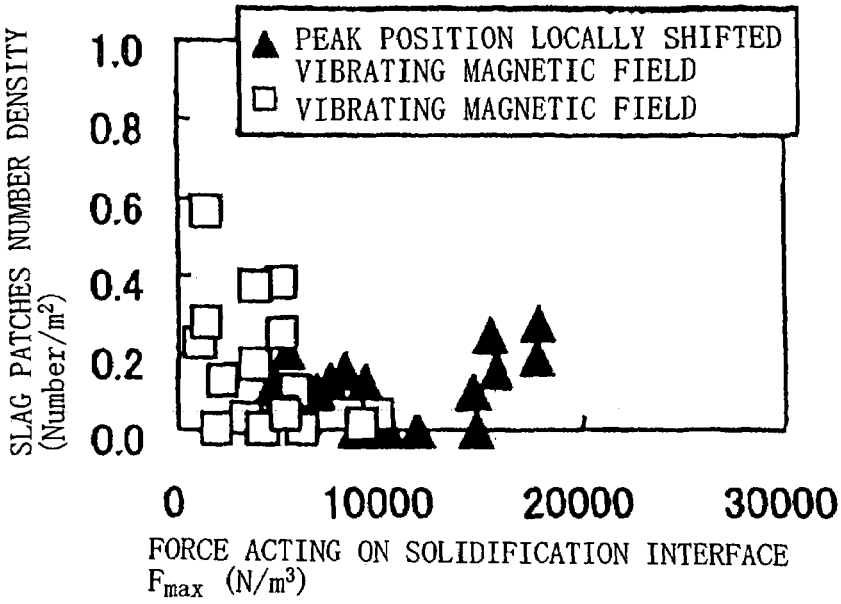
FIG. 28 is a plot showing the relationship between the maximum Lorentz force $F_{max}$ and the number density of slag patches.

In FIGS. 26 to 28, the horizontal axis represents the maximum Lorentz force $F_{max}$ acting on the solidification interfaces.

Figure 29:
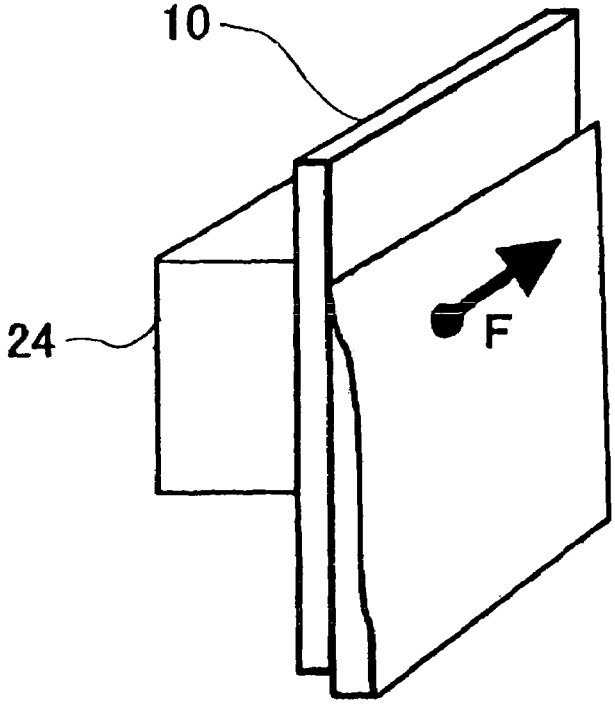
FIG. 29 is a schematic perspective view showing a Lorentz force acting on a solidification interface.

FIG. 29 schematically shows the relationship between the AC coils 24 and solidification interface of molten steel adhering to an inner wall of the mold 10, which is shown by a mold

TABLE 1

| | Alignment pattern of current phase | Number of phases of power source | Alternating magnetic field (G) | Direct-current magnetic field (G) | Index of defects by mold flux (–) | Index of air bubbles and inclusions in cast slab (–) | comprehensive evaluation |
|---|---|---|---|---|---|---|---|
| Comparative Example 1 | None | — | 0 | 0 | 5.2 | 10 | Bad |
| Comparative Example 2 | C | 3 | 1000 | 0 | 2.0 | 1.2 | Fair |
| Comparative Example 3 | D | 2 | 1000 | 0 | 2.5 | 1.8 | Fair |
| Comparative Example 4 | C | 3 | 2000 | 0 | 10 | 1.2 | Bad |
| Comparative Example 5 | D | 2 | 1000 | 1000 | 0.8 | 1.0 | Good |
| Example 1 | A | 2 | 1000 | 0 | 0.1 | 0.3 | Very good |
| Example 2 | A | 3 | 1000 | 500 | 0.1 | 0.2 | Very good |
| Example 3 | A | 3 | 2000 | 1000 | 0.05 | 0.05 | Very good |
| Example 4 | B | 2 | 500 | 0 | 0.1 | 0.3 | Very good |
| Example 5 | B | 2 | 800 | 1000 | 0.1 | 0.1 | Very good |
| Example 6 | B | 3 | 1000 | 0 | 0.2 | 0.3 | Very good |
| Example 7 | A | 2 | 1000 | 1000 | 0.1 | 0.1 | Very good |
| Example 8 | B | 3 | 1000 | 1000 | 0.05 | 0.05 | Very good |

steel plate. Changes in current passing through the AC coils 24 cause a Lorentz force F to act on the molten steel 14 at the solidification interfaces, as shown in FIG. 29.

Figure 30:
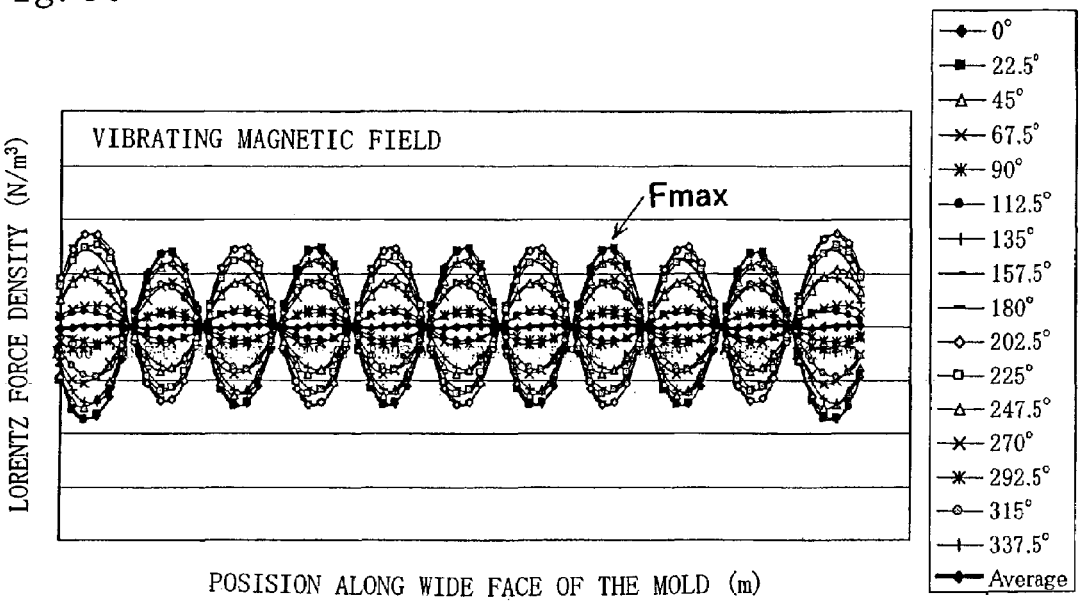
FIG. 30 is a plot of the distribution of Lorentz force (Lorentz force density).

When a direct-current magnetic field is superimposed on a vibrating magnetic field, as shown in FIGS. 6 and 19, the Lorentz force F is expressed by the above-described expressions (2) and (3). While the Bdc does not affect time-average force, force changing with time is increased according to the increase of the B value. The Lorentz force for each coil is periodically varied, as shown in FIG. 30 in which changes in current are represented by phases, and in which the horizontal axis represents the length of the mold 10.

When a vibrating magnetic field is applied, the maximum (peak) value $F_{max}$ (N/m$^3$) and the average value $F_{ave}$ (N/m$^3$) of Lorentz forces are expressed by the following equations obtained by regression calculation:

(Vibrating magnetic field)

$$F_{max}=1.57\times10^6 Bac\cdot Bdc+1.20\times10^6 Bac^2$$

$$F_{ave}=0$$

When a traveling magnetic field of FIG. 15 is applied and when a shifted vibrating magnetic field of FIG. 17 or 18 is applied (peak positions of the vibrating magnetic field are locally shifted), the following equations hold as above.

(Traveling magnetic field)

$$F_{max}=2.28\times10^6 Bac\cdot Bdc+4.17\times10^6 Bac^2$$

$$F_{ave}=1.76\times10^6 Bac^2$$

(Shifted vibrating magnetic field)

$$F_{max}=1.86\times10^6 Bac\cdot Bdc+2.31\times10^6 Bac^2$$

$$F_{ave}=6.36\times10^5 Bac^2$$

The maximum Lorentz forces $F_{max}$ shown in FIGS. 26 to 28 were calculated according to the equations above in continuous casting performed in practice, and the results were plotted corresponding to the maximum Lorentz forces $F_{max}$.

FIG. 26 suggests that $F_{max}$ in the range of 5,000 to 13,000 N/m$^3$ is effective at reducing the defect ratio. FIGS. 27 and 28 also suggest that $F_{max}$ of 5,000 N/m$^3$ or more is effective.

Figure 31:
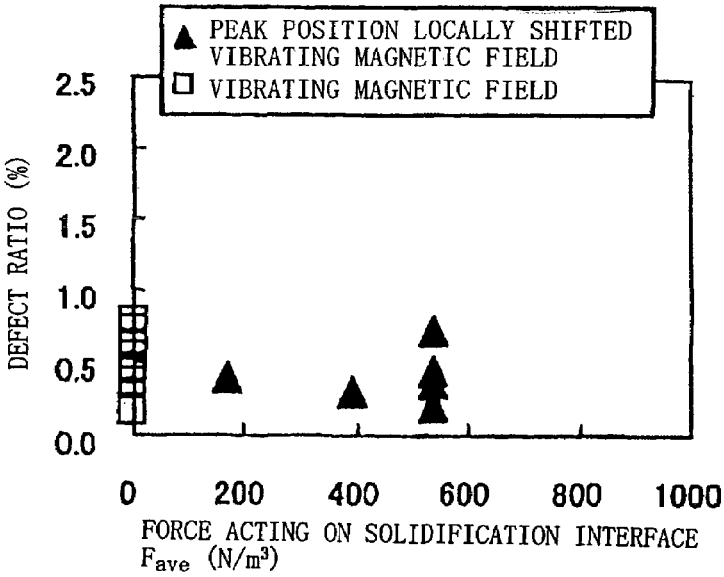
FIG. 31 is a plot showing the relationship between the average Lorentz force $F_{ave}$ and the ratio of the number of defects to the number of total products.
Figure 32:
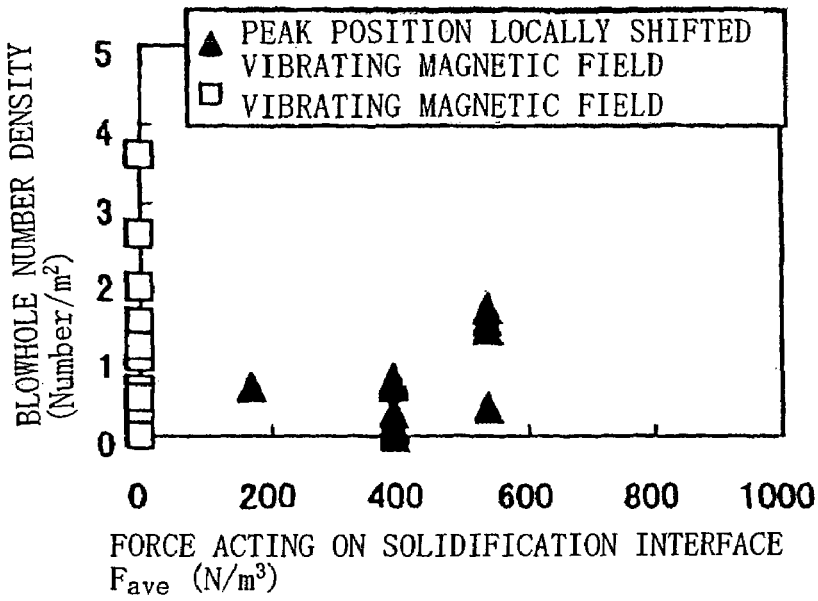
FIG. 32 is a plot showing the relationship between the average Lorentz force $F_{ave}$ and the number density of blowholes.
Figure 33:
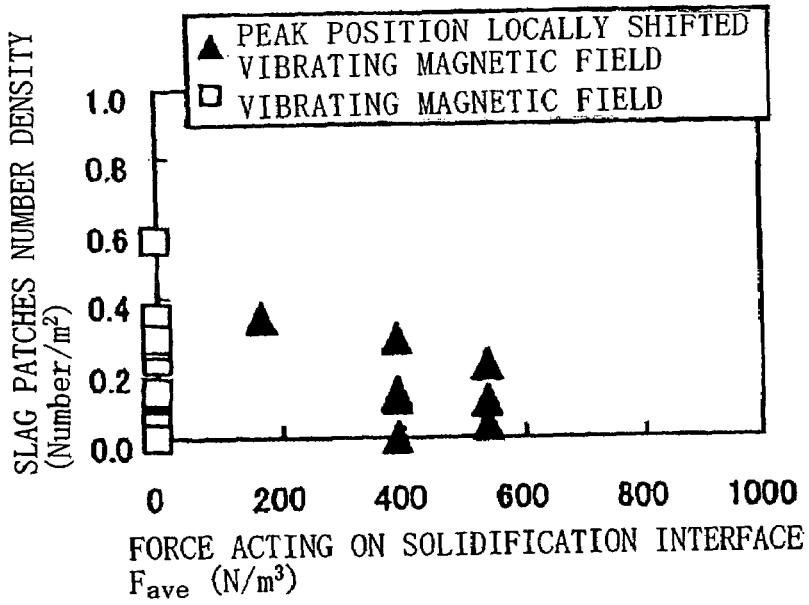
FIG. 33 is a plot showing the relationship between the average Lorentz force $F_{ave}$ and the number density of slag patches.

For reference purposes, FIGS. 31 to 33 show the relationships with $F_{ave}$. Although $F_{ave}$ is not suitable as an indicator of continuous casting, $F_{max}$ is useful as an indicator.

Fifth Example

Slabs were prepared with a continuous casting apparatus in the same manner as the fourth embodiment. The relationship between the defect ratio of the resulting slabs and the molten flow rate is shown in FIG. 34. The relationship between the defect ratio and the maximum Lorentz force $F_{max}$ is like shown in FIG. 26.

The molten steel flow rate V and the maximum Lorentz force $F_{max}$ were investigated in detail on the basis of these results, and it has been found that a $V\times F_{max}$ value of 3,000 or more reduces the defect ratio, as shown in FIG. 35. However, the effect of reducing the defect ratio is saturated at $V\times F_{max}$ values of more than 6,000, and the defect ratio is maintained at a certain level.

INDUSTRIAL APPLICABILITY

The present invention allows continuous casting without blowing an inert gas from an immersion nozzle, prevents the entrainment of mold flux to improve the internal quality of the resulting cast slab, and prevents the entrapment of inclusions and air bubbles to improve the surface quality of the cast slab.

The invention claimed is:

1. A continuous steel casting method comprising feeding molten steel into a mold, whereby solidification of the molten steel proceeds, and controlling a flow of unsolidified molten steel in the mold by applying a vibrating magnetic field which is generated with an arrangement of at least three electromagnets disposed along a longitudinal direction of the mold, peak positions of the vibrating magnetic field are shifted along the longitudinal direction of the mold, wherein the longitudinal direction of the mold is a direction along the wide face of the mold, wherein the vibrating magnetic field in which peak positions thereof are shifted along the longitudinal direction of the mold is generated by a vibrating magnetic field generator which comprises at least three magnetic poles including two adjacent pairs of magnetic poles where directions of electromagnetic forces of the adjacent pairs of magnetic poles are opposite to each other, wherein the total of each opposite electromagnetic forces in the at least three magnetic poles are not equal.

2. The continuous steel casting method according to claim 1, wherein the arrangement of at least three electromagnets has a part where coil phases of three adjacent electromagnets are in the order of n, 3n and 2n, or a part where coil phases of four adjacent electromagnets are in the order of 0, n, 2n and n.

3. The continuous steel casting method according to claim 1, wherein a direct-current magnetic field is superimposed on the vibrating magnetic field in a thickness direction of a cast slab.

4. The continuous steel casting method according to claim 1, wherein the molten steel is an ultra low carbon steel deoxidized by Ti having a composition containing: C≦0.020% by mass, Si≦0.2% by mass, Mn≦1.0% by mass, S≦0.050% by mass and Ti≦0.010% by mass, and satisfying the relationship Al≦Ti/5 on a content basis of percent by mass.

5. The continuous steel casting method according to claim 1, wherein the molten steel is decarburized with a vacuum degassing apparatus, subsequently deoxidized with a Ti-containing alloy, and then an alloy for controlling the composition of inclusions is added to the molten steel, wherein the alloy contains at least one metal selected from among 10% by mass or more of Ca and 5% by mass or more of rare earth metals and at least one element selected from the group consisting of Fe, Al, Si and Ti, wherein the resulting oxide in molten steel contains 10% to 50% by mass of at least one oxide selected from the group consisting of CaO and an REM oxide, 90% by mass or less of Ti oxide, and 70% by mass or less of $Al_2O_3$.

6. The continuous steel casting method according to claim 5, wherein the molten steel after the decarburization is predeoxidized with Al, Si, or Mn so that the concentration of dissolved oxygen in the molten steel is 200 ppm or less, before the deoxidation with the Ti-containing alloy.

7. The continuous steel casting method according to claim 1, wherein a maximum value of Lorentz forces induced by the vibrating magnetic field is in the range of 5,000 N/m$^3$ or more and 13,000 N/m$^3$ or less.

8. The continuous steel casting method according to claim 1, wherein a flow rate V (m/s) of the unsolidified molten steel in the mold for continuous casting and a maximum value $F_{max}$ (N/m$^3$) of Lorentz forces induced by the vibrating magnetic field are adjusted so that $V\times F_{max}$ is 3,000 N/(s·m$^2$) or more.

9. The continuous steel casting method according to claim 2, wherein a direct-current magnetic field is superimposed on the vibrating magnetic field in a thickness direction of a cast slab.

10. The continuous steel casting method according to claim 9, wherein the molten steel is an ultra low carbon steel deoxidized by Ti having a composition containing: C≦0.020% by mass, Si≦0.2% by mass,and Mn≦1.0% by mass, S≦0.050% by mass and Ti≦0.010% by mass, and satisfying the relationship Al≦Ti/5 on a content basis of percent by mass.

11. The continuous steel casting method according to claim 2, wherein the molten steel is decarburized with a vacuum degassing apparatus, subsequently deoxidized with a Ti-containing alloy, and then an alloy for controlling the composition of inclusions is added to the molten steel; wherein the alloy contains at least one metal selected from the group consisting of 10% by mass or more of Ca and 5% by mass or more of a rare earth metal and at least one element selected from the group consisting of Fe, Al, Si and Ti, and wherein the resulting oxide in the molten steel contains 10% to 50% by mass of at least one oxide selected from the group consisting of CaO and an REM oxide, 90% by mass or less of a Ti oxide, and 70% by mass or less of $Al_2O_3$.

12. The continuous steel casting method according to claim 3, wherein the molten steel is decarburized with a vacuum degassing apparatus, subsequently deoxidized with a Ti-containing alloy, and then an alloy for controlling the composition of inclusions is added to the molten steel; wherein the alloy contains at least one metal selected from the group consisting of 10% by mass or more of Ca and 5% by mass or more of a rare earth metal and at least one element selected from the group consisting of Fe, Al, Si and Ti, and wherein the resulting oxide in the molten steel contains 10% to 50% by mass of at least one oxide selected from the group consisting of CaO and an REM oxide, 90% by mass or less of a Ti oxide, and 70% by mass or less of $Al_2O_3$.

13. The continuous steel casting method according to claim 2, wherein the molten steel is an ultra low carbon steel deoxidized by Ti having a composition containing: C≦0.020% by mass, Mn≦1.0% by mass, S≦0.050% by mass, and Ti≧0.010% by mass, and satisfying the relationship Al≦Ti/5 on a content basis of percent by mass.

14. The continuous steel casting method according to claim 3, wherein the molten steel is an ultra low carbon steel deoxidized by Ti having a composition containing: C≦0.020% by mass, Mn≦1.0% by mass, S≦0.050% by mass, and Ti≧0.010% by mass, and satisfying the relationship Al≦Ti/5 on a content basis of percent by mass.

15. The continuous steel casting method according to claim 13, wherein the molten steel is decarburized with a vacuum degassing apparatus, subsequently deoxidized with a Ti-containing alloy, and then an alloy for controlling the composition of inclusions is added to the molten steel, wherein the alloy contains at least one metal selected from among 10% by mass or more of Ca and 5% by mass or more of rare earth metals and at least one element selected from the group consisting of Fe, Al, Si, and Ti, and wherein the resulting oxide in molten steel contains 10% to 50% by mass of at least one selected from the groups consisting of CaO and REM oxides, 90% by mass or less of Ti oxide, and 70% by mass or less of $Al_2O_3$.

16. The continuous steel casting method according to claim 14, wherein the molten steel is decarburized with a vacuum degassing apparatus, subsequently deoxidized with a Ti-containing alloy, and then an alloy for controlling the composition of inclusions is added to the molten steel, wherein the alloy contains at least one metal selected from among 10% by mass or more of Ca and 5% by mass or more of rare earth metals and at least one element selected from the group consisting of Fe, Al, Si, and Ti, and wherein the resulting oxide in molten steel contains 10% to 50% by mass of at least one selected from the groups consisting of CaO and REM oxides, 90% by mass or less of Ti oxide, and 70% by mass or less of $Al_2O_3$.

17. The continuous steel casting method according to claim 15, wherein the molten steel after the decarburization is pre-deoxidized with Al, Si, or Mn so that the concentration of dissolved oxygen in the molten steel is 200 ppm or less, before the deoxidation with the Ti-containing alloy.

18. The continuous steel casting method according to claim 16, wherein the molten steel after the decarburization is pre-deoxidized with Al, Si, or Mn so that the concentration of dissolved oxygen in the molten steel is 200 ppm or less, before the deoxidation with the Ti-containing alloy.

19. The continuous steel casting method according to claim 2, wherein a maximum value of Lorentz forces induced by the vibrating magnetic field is in the range of 5,000 $N/m^3$ or more and 13,000 $N/m^3$ or less.

20. The continuous steel casting method according to claim 3, wherein a maximum value of Lorentz forces induced by the vibrating magnetic field is in the range of 5,000 $N/m^3$ or more and 13,000 $N/m^3$ or less.

21. The continuous steel casting method according to claim 5, wherein a maximum value of Lorentz forces induced by the vibrating magnetic field is in the range of 5,000 $N/m^3$ or more and 13,000 $N/m^3$ or less.

22. The continuous steel casting method according to claim 4, wherein a maximum value of Lorentz forces induced by the vibrating magnetic field is in the range of 5,000 $N/m^3$ or more and 13,000 $N/m^3$ or less.

23. The continuous steel casting method according to claim 2, wherein a flow rate V (m/s) of the unsolidified molten steel in the mold for continuous casting and a maximum value $F_{max}$ ($N/m^3$) of Lorentz forces induced by the vibrating magnetic field are adjusted so that $V \times F_{max}$ is 3,000 $N/(s \cdot m^2)$ or more.

24. The continuous steel casting method according to claim 3, wherein a flow rate V (ms) of the unsolidified molten steel in the mold for continuous casting and a maximum value $F_{max}$ ($N/m^3$) of Lorentz forces induced by the vibrating magnetic field are adjusted so that $V \times F_{max}$ is 3,000 $N/(s \cdot m^2)$ or more.

25. The continuous steel casting method according to claim 5, wherein a flow rate V (m/s) of the unsolidified molten steel in the mold for continuous casting a maximum value $F_{max}$ ($N/m^3$) of Lorentz forces induced by the vibrating magnetic field are adjusted so that $V \times F_{max}$ is 3,000 $N/(s \cdot m^2)$ or more.

26. The continuous steel casting method according to claim 4, wherein a flow rate V (m/s) of the unsolidified molten steel in the mold for continuous casting and a maximum value $F_{max}$ ($N/m^3$) of Lorentz forces induced by the vibrating magnetic field are adjusted so that $V \times F_{max}$ is 3,000 $N/(s \cdot m^2)$ or more.

* * * * *